US007686106B2

(12) United States Patent
Baker et al.

(10) Patent No.: US 7,686,106 B2
(45) Date of Patent: Mar. 30, 2010

(54) ROCK BIT AND INSERTS WITH WEAR RELIEF GROOVES

(75) Inventors: Bryce A. Baker, Houston, TX (US); Amardeep Singh, Houston, TX (US)

(73) Assignee: Smith International, Inc., Houston, TX (US)

( * ) Notice: Subject to any disclaimer, the term of this patent is extended or adjusted under 35 U.S.C. 154(b) by 204 days.

(21) Appl. No.: 11/619,416

(22) Filed: Jan. 3, 2007

(65) Prior Publication Data

US 2008/0156542 A1 Jul. 3, 2008

(51) Int. Cl.
*E21B 10/08* (2006.01)

(52) U.S. Cl. ..... 175/431; 175/331; 175/430

(58) Field of Classification Search ..... 175/331, 175/374, 426, 428, 430, 431
See application file for complete search history.

(56) References Cited

U.S. PATENT DOCUMENTS

| | | | | |
|---|---|---|---|---|
| 2,578,593 | A | 12/1951 | Phipps | |
| 3,388,757 | A * | 6/1968 | Fittinger | 175/410 |
| 3,442,342 | A * | 5/1969 | McElya et al. | 175/374 |
| 3,946,820 | A | 3/1976 | Knapp | |
| 4,056,153 | A | 11/1977 | Miglierini | |
| 4,058,177 | A | 11/1977 | Langford, Jr. et al. | |
| 4,086,973 | A | 5/1978 | Keller et al. | |
| 4,108,260 | A | 8/1978 | Bozarth | |
| 4,254,840 | A * | 3/1981 | Shay, Jr. | 175/410 |
| 4,334,586 | A | 6/1982 | Schumacher | |
| 4,352,400 | A | 10/1982 | Grappendorf et al. | |
| 4,511,006 | A | 4/1985 | Grainger | |
| 4,586,574 | A | 5/1986 | Grappendorf | |
| 4,716,977 | A | 1/1988 | Huffstutler | |
| 4,722,405 | A | 2/1988 | Langford, Jr. | |
| 4,811,801 | A | 3/1989 | Salesky et al. | |
| 4,832,139 | A | 5/1989 | Minikus et al. | |
| 4,854,405 | A | 8/1989 | Stroud | |
| 4,951,762 | A | 8/1990 | Lundell | |
| D324,527 | S | 3/1992 | Slutz | |
| 5,131,478 | A | 7/1992 | Brett et al. | |
| 5,172,777 | A | 12/1992 | Siracki et al. | |
| 5,172,779 | A | 12/1992 | Siracki et al. | |
| 5,197,555 | A | 3/1993 | Estes | |

(Continued)

FOREIGN PATENT DOCUMENTS

| | | |
|---|---|---|
| EP | 0 391 683 | 10/1990 |

(Continued)

OTHER PUBLICATIONS

Search Report for Appln. No. GB 0 403 620.8 dated May 5, 2004 (2 p.).

(Continued)

*Primary Examiner*—William P Neuder
*Assistant Examiner*—Nicole A Coy
(74) *Attorney, Agent, or Firm*—Conley Rose, P.C.

(57) ABSTRACT

A rolling cone drill bit includes at least one cutter element comprising a base portion and a cutting portion extending from the base portion. The cutting portion includes a cutting surface with an apex defining an extension height and at least one rib extending from the apex toward the base portion. In addition, the at least one rib has a convex outer surface in profile view.

27 Claims, 11 Drawing Sheets

U.S. PATENT DOCUMENTS

| | | | | |
|---|---|---|---|---|
| 5,201,376 | A | 4/1993 | Williams | |
| 5,303,787 | A | 4/1994 | Brady | |
| 5,322,138 | A | 6/1994 | Siracki | |
| 5,323,865 | A | 6/1994 | Isbell et al. | |
| 5,341,890 | A | 8/1994 | Cawthorne et al. | |
| 5,351,768 | A | 10/1994 | Scott et al. | |
| 5,372,210 | A | 12/1994 | Harrell | |
| 5,379,854 | A | 1/1995 | Dennis | |
| 5,407,022 | A | 4/1995 | Scott et al. | |
| 5,415,244 | A | 5/1995 | Portwood | |
| 5,421,423 | A | 6/1995 | Huffstutler | |
| 5,421,424 | A | 6/1995 | Portwood et al. | |
| 5,429,199 | A | 7/1995 | Sheirer et al. | |
| 5,429,200 | A | 7/1995 | Blackman et al. | |
| 5,452,771 | A | 9/1995 | Blackman et al. | |
| 5,479,997 | A | 1/1996 | Scott et al. | |
| 5,518,077 | A | 5/1996 | Blackman et al. | |
| 5,533,582 | A | 7/1996 | Tibbitts | |
| 5,535,839 | A | 7/1996 | Brady | |
| 5,542,485 | A | 8/1996 | Pessier et al. | |
| 5,560,440 | A | 10/1996 | Tibbits | |
| 5,592,995 | A | 1/1997 | Scott et al. | |
| 5,636,700 | A | 6/1997 | Shamburger, Jr. | |
| 5,644,956 | A | 7/1997 | Blackman et al. | |
| 5,695,019 | A | 12/1997 | Shamburger, Jr. | |
| 5,697,462 | A | 12/1997 | Grimes et al. | |
| 5,709,278 | A | 1/1998 | Crawford | |
| 5,743,346 | A | 4/1998 | Flood et al. | |
| 5,746,280 | A * | 5/1998 | Scott et al. | 175/374 |
| 5,752,573 | A * | 5/1998 | Scott et al. | 175/374 |
| 5,755,301 | A | 5/1998 | Love et al. | |
| 5,813,485 | A | 9/1998 | Portwood | |
| 5,819,861 | A | 10/1998 | Scott et al. | |
| 5,833,020 | A | 11/1998 | Portwood et al. | |
| 5,839,526 | A | 11/1998 | Cisneros et al. | |
| 5,871,060 | A | 2/1999 | Jensen et al. | |
| 5,874,060 | A | 2/1999 | Armour et al. | |
| 5,881,828 | A | 3/1999 | Fischer et al. | |
| 5,887,655 | A | 3/1999 | Haugen et al. | |
| 5,887,668 | A | 3/1999 | Haugen et al. | |
| 5,890,550 | A | 4/1999 | Swadi et al. | |
| 5,915,486 | A | 6/1999 | Portwood et al. | |
| 5,950,745 | A | 9/1999 | Ingmarsson | |
| 5,967,245 | A | 10/1999 | Garcia et al. | |
| 6,029,759 | A | 2/2000 | Sue et al. | |
| 6,053,263 | A | 4/2000 | Meiners | |
| 6,059,054 | A | 5/2000 | Portwood et al. | |
| 6,105,693 | A | 8/2000 | Ingmarsson | |
| 6,105,694 | A | 8/2000 | Scott | |
| D430,578 | S | 9/2000 | Brady | |
| 6,161,634 | A | 12/2000 | Minikus et al. | |
| 6,176,332 | B1 | 1/2001 | Massa et al. | |
| 6,176,333 | B1 * | 1/2001 | Doster | 175/428 |
| 6,196,340 | B1 | 3/2001 | Jensen et al. | |
| 6,199,645 | B1 | 3/2001 | Anderson et al. | |
| 6,202,752 | B1 | 3/2001 | Kuck et al. | |
| 6,241,034 | B1 | 6/2001 | Steinke et al. | |
| 6,241,035 | B1 | 6/2001 | Portwood | |
| 6,290,008 | B1 | 9/2001 | Portwood et al. | |
| 6,367,568 | B2 | 4/2002 | Steinke et al. | |
| 6,510,910 | B2 * | 1/2003 | Eyre et al. | 175/430 |
| 6,530,441 | B1 | 3/2003 | Singh et al. | |
| 6,561,293 | B2 | 5/2003 | Minikus et al. | |
| 6,595,305 | B1 | 7/2003 | Dunn et al. | |
| 6,601,662 | B2 | 8/2003 | Matthias et al. | |
| 6,745,645 | B2 | 6/2004 | Griffo | |
| 6,782,959 | B2 | 8/2004 | Minikus et al. | |
| 6,883,624 | B2 | 4/2005 | McDonough | |
| 6,929,079 | B2 | 8/2005 | McDonough et al. | |
| 7,013,999 | B2 | 3/2006 | Tufts | |
| 7,040,424 | B2 | 5/2006 | Young et al. | |
| 7,152,703 | B2 * | 12/2006 | Meiners et al. | 175/426 |
| 2004/0173384 | A1 | 9/2004 | Young et al. | |
| 2005/0247492 | A1 * | 11/2005 | Shen et al. | 175/426 |

FOREIGN PATENT DOCUMENTS

| | | |
|---|---|---|
| EP | 0 446 765 | 9/1991 |
| EP | 0 527 506 | 2/1993 |
| EP | 0 902 159 | 3/1999 |
| GB | 2 361 497 | 10/2001 |
| GB | 2 369 841 | 6/2002 |
| GB | 2 393 982 | 4/2004 |
| GB | 2398330 | 8/2004 |
| RU | 2105124 | 2/1998 |
| RU | 2153569 | 7/2000 |
| WO | WO 01/61142 | 8/2001 |

OTHER PUBLICATIONS

Search Report for Appln. No. GB 0 402 108.5 dated Apr. 22, 2004; (1 p.).
Search Report for Appln. No. GB 0 416617.9 dated Sep. 9, 2004; (1 p.).
Search Report for Appln. No. GB 0404709.8 dated Sep. 23, 2004; (1 p.).
Office Action dated May 17, 2007 for U.S. Appl. No. 11/157,656; (18 p.).
Response to Office Action Dated May 17, 2007 for U.S. Appl. No. 11/157,656; (23 p.).
Office Action dated Aug. 31, 2007 for U.S. Appl. No. 11/157,656; (12 p.).
Response to Office Action Dated Aug. 31, 2007 for U.S. Appl. No. 11/157,656; (19 p.).
Final Office Action Dated Feb. 19, 2008 for U.S. Appl. No. 11/157,656 (18 p.).
Response to Final Action Dated Feb. 19, 2008 for U.S. Appl. No. 11/157,656 (15 p.).
Advisory Action Dated May 5, 2008 for U.S. Appl. No. 11/157,656 (3 p.).
Request for Continued Examination (RCE) with Preliminary Amendment for U.S. Appl. No. 11/157,656 (25 p.).
Office Action Dated Oct. 17, 2008 for U.S. Appl. No. 11/157,656 (4 p.).
Response to Office Action Dated Oct. 17, 2008 for U.S. Appl. No. 11/157,656 (5 p.).
Notice of Allowance and Fee(s) Due Dated Dec. 8, 2008 for U.S. Appl. No. 11/157,656; (4 p.).
Office Action dated Apr. 22, 2009 for U.S. Appl. No. 11/157,656 (8 p.).
Response to Office Action dated Apr. 22, 2009 for U.S. Appl. No. 11/157,656 (16 p.).
Notice of Allowance and Fee(s) Due for U.S. Appl. No. 11/157,656 (4 p.).
Office Action dated Nov. 13, 2008 for U.S. Appl. No. 11/619,395 (14 p.).
Response to Office Action dated Nov. 13, 2008 for U.S. Appl. No. 11/619,395 (24 p.).
Notice of Allowance and Fee(s) Due for U.S. Appl. No. 11/619,395 (6 p.).
Office Action dated Aug. 25, 2009 for U.S. Appl. No. 11/858,359 (24 p.).
Office Action dated Jul. 9, 2009 for U.S. Appl. No. 11/947,226 (13 p.).
Response to Restriction Requirement and Response to Office Action dated Jul. 9, 2009 for U.S. Appl. No. 11/947,226 (15 p.).
Office Action Dated Sep. 3, 2004 for U.S. Appl. No. 10/371,388 (5 p.).
Response to Office Action Dated Sep. 3, 2004 for U.S. Appl. No. 10/371,388 (15 p.).
Notice of Allowance for U.S. Appl. No. 10/371,388 dated Apr. 13, 2005 (6 p).
Office Action Dated Sep. 23, 2004 for U.S. Appl. No. 10/379,015 (12 p.).

Response to Office Action Dated Sep. 23, 2004 for U.S. Appl. No. 10/379,015 (23 p).

Office Action Dated Feb. 22, 2005 for U.S. Appl. No. 10/379,015 (7 p.).

Response to Office Action Dated Feb. 22, 2005 for U.S. Appl. No. 10/379,015 (19 p).

Office Action dated Aug. 29, 2005 for U.S. Appl. No. 10/379,015 (7 p.).

Response to Office Action dated Aug. 29, 2005 for U.S. Appl. No. 10/379,015 (19 p.).

Notice of Allowance dated Jan. 31, 2006 for U.S. Appl. No. 10/379,016 (6 p.).

Office Action Dated Apr. 28, 2005 for U.S. Appl. No. 10/628,191 (12 p.).

Response to Office Action Dated Apr. 28, 2005 for U.S. Appl. No. 10/628,191 (26 p.).

Notice of Allowance Dated Oct. 12, 2005 for U.S. Appl. No. 10/628,191 (4 p.).

Office Action Dated Apr. 13, 2004 for U.S. Appl. No. 10/355,493 (10 p.).

Response to Office Action Dated Apr. 13, 2004 for U.S. Appl. No. 10/355,493 (32 p.).

Final Office Action Dated Aug. 23, 2004 for U.S. Appl. No. 10/355,493 (7 p.).

Response to Final Office Action Dated Aug. 23, 2004 for U.S. Appl. No. 10/355,493 (19 p).

Notice of Allowance Dated Dec. 20, 2004 for U.S. Appl. No. 10/355,493 (6 p).

* cited by examiner

ROCK BIT AND INSERTS WITH WEAR RELIEF GROOVES

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE TECHNOLOGY

1. Field of the Invention

The invention relates generally to earth-boring bits used to drill a borehole for the ultimate recovery of oil, gas or minerals. More particularly, the invention relates to rolling cone rock bits and to an improved cutting structure and cutter element for such bits.

2. Background Information

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones. The borehole is formed as the gouging and scraping or crushing and chipping action of the rotary cones remove chips of formation material which are carried upward and out of the borehole by drilling fluid which is pumped downwardly through the drill pipe and out of the bit.

The earth disintegrating action of the rolling cone cutters is enhanced by providing the cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits or "insert" bits, while those having teeth formed from the cone material are known as "steel tooth bits." In each instance, the cutter elements on the rotating cutters break up the formation to form a new borehole by a combination of gouging and scraping or chipping and crushing.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer and which are usable over a wider range of formation hardness.

The length of time that a drill bit may be employed before it must be changed depends upon its rate of penetration ("ROP"), as well as its durability. The form and positioning of the cutter elements upon the cone cutters greatly impact bit durability and ROP, and thus are critical to the success of a particular bit design.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP, increased loading on the other cutter elements on the bit, and may accelerate wear of the cutter bearing, and ultimately lead to bit failure.

Conventional bits also typically include one or more rows of gage cutter elements. Gage row elements are mounted adjacent to the heel surface but orientated and sized in such a manner so as to cut the corner of the borehole. In this orientation, the gage cutter elements generally are required to cut both the borehole bottom and sidewall. The lower surface of the gage row cutter elements engage the borehole bottom while the radially outermost surface scrapes the sidewall of the borehole.

Conventional bits also include a number of additional rows of cutter elements that are located on the cones in rows disposed radially inward from the gage row. These cutter elements are sized and configured for cutting the bottom of the borehole and are typically described as bottomhole or inner row cutter elements. In contrast to gage and heel row inserts that ream the sidewall of the borehole and cut formation via a scraping or shearing action, inner row inserts are intended to impact, penetrate, and remove formation material by gouging, crushing, and fracturing formation material. Consequently, in many applications, inner row cutter elements are sharper than those typically employed in the gage row or the heel rows.

Inserts in TCI bits have been provided with various geometries. One insert typically employed in an inner row may generally be described as a "conical" insert, one having a cutting surface that tapers from a cylindrical base to a pointed or a generally rounded apex. Another common shape for an insert for use in inner rows is what generally may be described as a "chisel" shaped. Rather then having the pointed or spherical apex of the conical insert, a chisel insert generally includes two generally flattened sides or flanks that converge and terminate in an elongate crest at the terminal end of the insert. The chisel element may have rather sharp transitions where the flanks intersect the more rounded portions of the cutting surface, as shown, for example, in FIGS. 1-8 in U.S. Pat. No. 5,172,779. As a result, such inserts are generally more aggressive and effective at penetrating the formation as the weight applied to the formation through the insert is concentrated, at least initially, on the relatively small surface area of the crest. However, the relatively sharp cutting edges endure high stresses that may lead to chipping and ultimately breakage of the insert. And further, although inner row inserts with sharper geometries provide reasonable rates of penetration, they tend to wear at a fast rate, particularly in hard abrasive formations. Both wear and breakage may cause a bit's ROP to drop dramatically, as for example, from 80 feet per hour to less than 10 feet per hour. Once the cutting structure is damaged and the rate of penetration reduced to an unacceptable rate, the drill string must be removed in order to replace the drill bit. As mentioned, this "trip" of the drill string is extremely time consuming and expensive to the driller.

Another type of insert that can be employed in an inner row may be described as a "dome-shaped," "semi-round top," or "hemispherical" insert. As the description implies, such inserts have a more rounded cutting surface that is free of sharp cutting edges and crests. As compared to more aggressive inserts, dome-shaped inserts tend to be more abrasion resistant since they generally have more insert material in their cutting portions. Further, lacking sharp cutting edges and crests, such inserts are less susceptible to chipping and fracturing. Although conventional dome-shaped inserts are more robust and durable than conventional aggressive inner row inserts, dome-shaped inserts are less effective at penetrating the uncut formation and removing formation material, and therefore, typically provide lower ROP.

As will be understood then, there remains a need in the art for a cutter element and cutting structure that will provide a high rate of penetration and be durable enough to withstand hard and abrasive formations.

Increasing ROP while maintaining good cutter and bit life to increase the footage drilled is still an important goal so as to decrease drilling time and recover valuable oil and gas more economically. Accordingly, there remains a need in the art for a drill bit and cutting elements that will yield a high ROP and footage drilled. Such a drill bit and cutting elements would be particularly well received if it was sufficiently durable and had a geometry less susceptible to breakage.

SUMMARY OF SOME OF THE PREFERRED EMBODIMENTS

In accordance with at least one embodiment, a cutter element for a drill bit comprises a base portion. In addition, the cutter element comprises a cutting portion extending from the base portion and having a cutting surface with an apex. Further, the cutting surface includes at least one rib extending from the apex toward the base portion and a continuously contoured concave depression positioned adjacent the at least one rib and between the apex and the base portion. The at least one rib has a convex outer surface in profile view.

In accordance with another embodiment, a cutter element for use in a rolling cone drill bit comprises a base portion. In addition, the cutter element comprises a cutting portion extending from the base portion and having a cutting surface with an apex. The cutting surface includes a plurality of ribs, wherein each rib radiates from the apex and extends toward the base portion. Moreover, at least one of the plurality of ribs has a continuously contoured outer surface in profile view, and a pair of arcuate lateral sides in top axial view.

In accordance with another embodiment, a rolling cone drill bit for drilling a borehole in earthen formations comprises a bit body having a bit axis. In addition, the rolling cone drill bit comprises at least one rolling cone cutter mounted on the bit body for rotation about a cone axis and having a first surface for cutting the borehole bottom and second surface for cutting the borehole sidewall. Further, the rolling cone drill bit comprises a plurality of cutter elements secured to the cone cutter and extending from the first surface. At least one of the cutter elements includes a base portion and a cutting portion extending from the base portion. The cutting portion includes a cutting surface with an apex defining an extension height and at least one rib extending from the apex toward the base portion. Still further, the at least one rib has a convex outer surface in profile view.

In accordance with another embodiment, a rolling cone drill bit for drilling through earthen formations to form a borehole with a hole bottom and a sidewall comprises at least one rolling cone cutter rotatably mounted on a bit body. The rolling cone cutter including a first surface generally facing the borehole bottom and a second surface generally facing the sidewall of the borehole. In addition, the rolling cone drill bit includes at least one cutter element mounted in the rolling cone cutter and secured in a position to cut against the borehole bottom. The at least one cutter element comprises a base portion and a cutting portion having a cutting surface extending from the base portion to a contoured tip. Further, the cutting surface includes a plurality of ribs disposed between the tip and the base portion. Each rib has a continuously contoured outer surface in profile view and a pair of arcuate lateral sides in top axial view.

Thus, the embodiments described herein comprise a combination of features and characteristics which are directed to overcoming some of the shortcomings of prior bits and cutter element designs. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiments of the present invention, reference will now be made to the accompanying drawings, wherein.

DETAILED DESCRIPTION OF THE PREFERRED EMBODIMENTS

Figure 1:
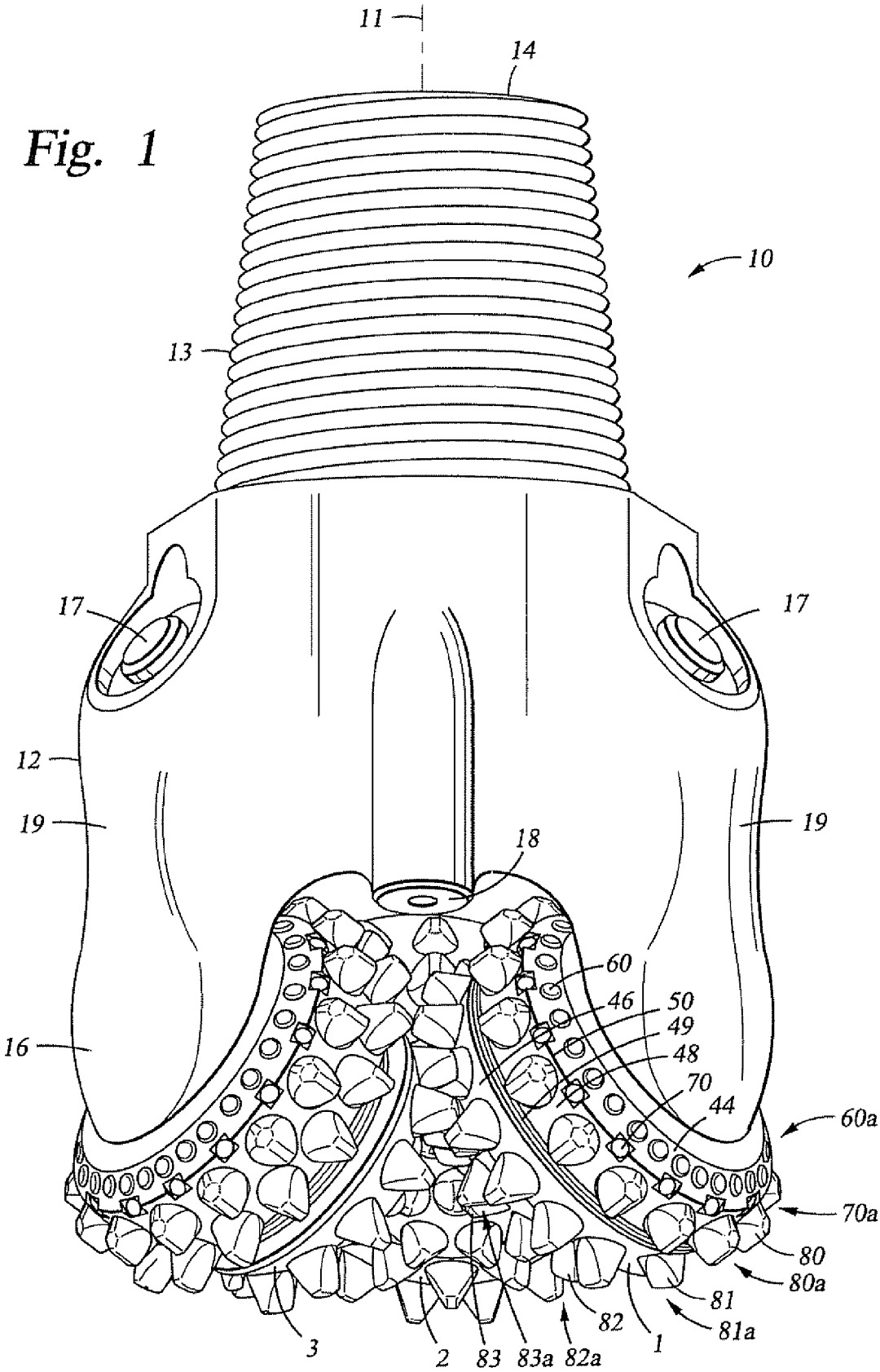
FIG. 1 is a perspective view of an earth-boring bit made in accordance with the principles described herein.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices and connections.

Referring first to FIG. 1, an earth-boring bit 10 is shown to include a central axis 11 and a bit body 12 having a threaded pin section 13 at its upper end that is adapted for securing the bit to a drill string (not shown). The uppermost end will be referred to herein as pin end 14. Bit 10 has a predetermined gage diameter as defined by the outermost reaches of three rolling cone cutters 1, 2, 3 which are rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cone cutters 1-3. Bit 10 includes lubricant reservoirs 17 that supply lubricant to the bearings that support each of the cone cutters. Bit legs 19 include a shirttail portion 16 that serves to protect the cone bearings and cone seals from damage as might be caused by cuttings and debris entering between leg 19 and its respective cone cutter.

Figure 2:
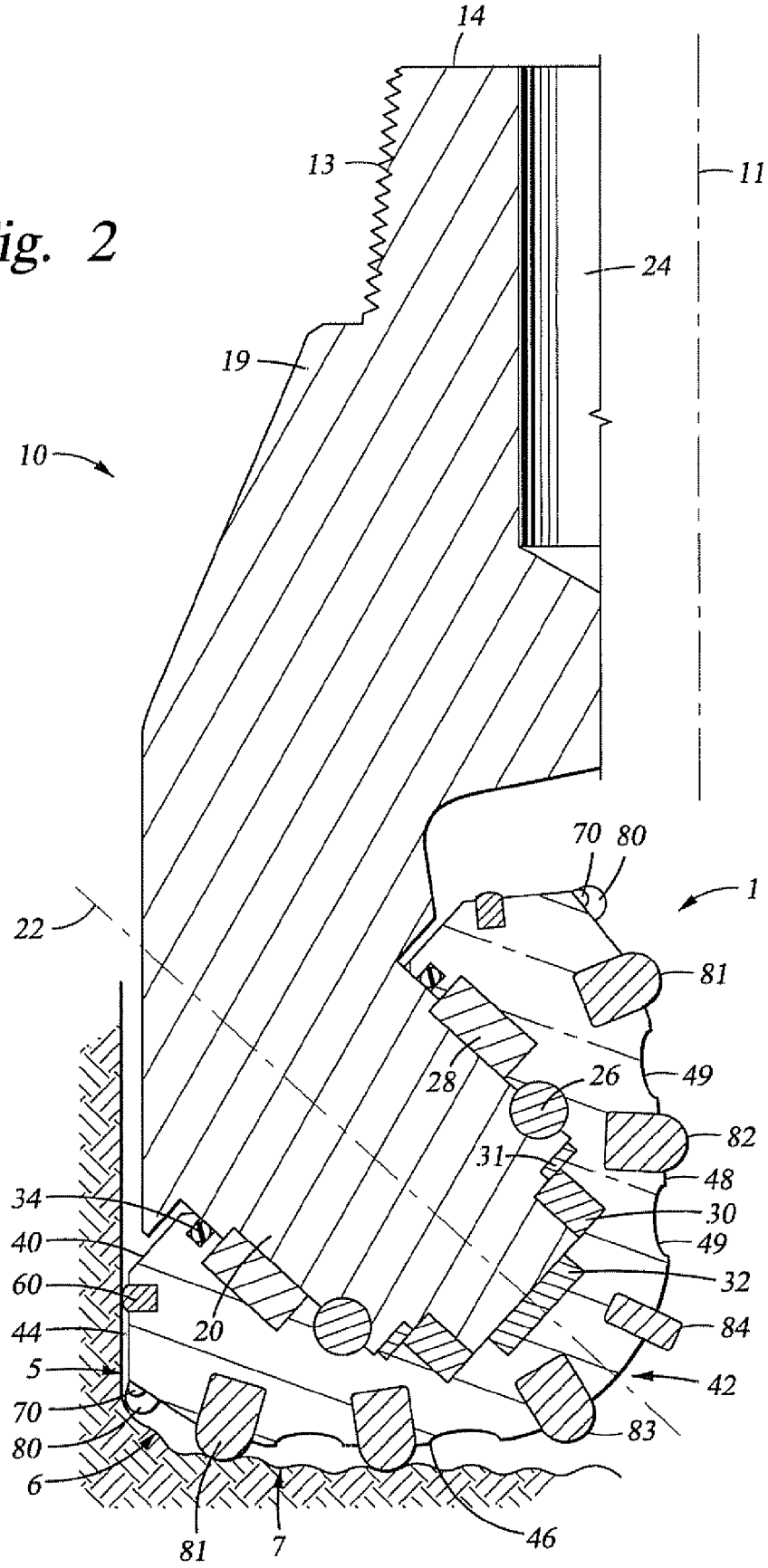
FIG. 2 is a partial section view taken through one leg and one rolling cone cutter of the bit shown in FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial and axial thrust are absorbed by roller bearings 28, 30, thrust washer 31 and thrust plug 32. The bearing structure shown is generally referred to as a roller bearing; however, the invention is not limited to use in bits having such structure, but may equally be applied in a bit where cone cutters 1-3 are mounted on pin 20 with a journal bearing or friction bearing disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. Drilling fluid is pumped from the surface through fluid passage 24 where it is circulated through an internal passageway (not shown) to nozzles 18 (FIG. 1). The borehole created by bit 10 includes sidewall 5, corner portion 6, and bottom 7, best shown in FIG. 2.

Referring still to FIGS. 1 and 2, each cone cutter 1-3 includes a generally planar backface 40 and nose portion 42 opposite backface 40. Adjacent to backface 40, cutters 1-3 further include a generally frustoconical surface 44 that is adapted to retain cutter elements that scrape or ream the sidewalls of the borehole as the cone cutters rotate about the borehole bottom. Frustoconical surface 44 will be referred to herein as the "heel" surface of cone cutters 1-3. It is to be understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as cone cutters 1-3 rotate about the borehole. Frustoconical heel surface 44 and conical surface 46 converge in a circumferential edge or shoulder 50, best shown in FIG. 1. Although referred to herein as an "edge" or "shoulder," it should be understood that shoulder 50 may be radiused to various degrees such that shoulder 50 will define a transition zone of convergence between frustoconical heel surface 44 and the conical surface 46. Conical surface 46 is divided into a plurality of generally frustoconical regions or bands 48 generally referred to as "lands" which are employed to support and secure the cutter elements as described in more detail below. Grooves 49 are formed in cone surface 46 between adjacent lands 48.

In the bit shown in FIGS. 1 and 2, each cone cutter 1-3 includes a plurality of wear resistant cutter elements in the form of inserts which are disposed about the cone and arranged in circumferential rows in the embodiment shown. More specifically, rolling cone cutter 1 includes a plurality of heel inserts 60 that are secured in a circumferential row **60*a* in the frustoconical heel surface 44. Cone cutter 1 further includes a first circumferential row 70*a* of gage inserts 70 secured to cone cutter 1 in locations along or near the circumferential shoulder 50. Additionally, the cone cutter includes a second circumferential row 80*a* of gage inserts 80. The cutting surfaces of inserts 70, 80 have differing geometries, but each extends to full gage diameter. Row 70*a* of the gage inserts is sometimes referred to as the binary row and inserts 70 sometimes referred to as binary row inserts. The cone cutter 1 further includes inner row inserts 81, 82, 83 secured to cone surface 46 and arranged in concentric, spaced-apart inner rows 81*a*, 82*a*, 83*a*, respectively. Heel inserts 60 generally function to scrape or ream the borehole sidewall 5 to maintain the borehole at full gage and prevent erosion and abrasion of the heel surface 44. Gage inserts 70, 80 function primarily to cut the corner of the borehole. Inner row cutter elements 81, 82, 83 of inner rows 81*a*, 82*a*, 83*a* are employed to gouge and remove formation material from the remainder of the borehole bottom 7. Inner rows 81*a*, 82*a*, 83*a* are arranged and spaced on rolling cone cutters 1 so as not to interfere with rows of inner row cutter elements on the other cone cutters 2, 3. Cone 1 is further provided with relatively small "ridge cutter" cutter elements 84 in nose region 42 which tend to prevent formation build-up between the cutting paths followed by adjacent rows of the more aggressive, primary inner row cutter elements from different cone cutters. Cone cutters 2 and 3 have heel, gage and inner row cutter elements and ridge cutters that are similarly, although not identically, arranged as compared to cone 1. The arrangement of cutter elements differs as between the three cones in order to maximize borehole bottom coverage, and also to provide clearance for the cutter elements on the adjacent cone cutters. For instance, in some embodiments, inner row inserts 81, 82, 83 are arranged and spaced on each cone cutter 1-3 so as to intermesh, yet not interfere with the inner row inserts 81, 82, 83 of the other cone cutters 1-3. In such embodiments, grooves 49 on each cone 1-3 allow the cutting surfaces of certain bottomhole cutter elements 81, 82, 83 of adjacent cone cutters 1-3 to intermesh, without contacting the cone steel or surface of cones 1-3**.

In the embodiment shown, inserts 60, 70, 80-83 each include a generally cylindrical base portion, a central axis, and a cutting portion that extends from the base portion, and further includes a cutting surface for cutting the formation material. The base portion is secured into a mating socket formed in the surface of the cone cutter. The base portion may be secured within the mating socket by any suitable means including, without limitation, an interference fit, brazing, or combinations thereof. The "cutting surface" of an insert is defined herein as being that surface of the insert that extends beyond the surface of the cone cutter. Further, it is to be understood that the extension height of an insert or cutter element is the distance from the cone surface to the outermost point of the cutting surface of the cutter element as measured substantially perpendicular to the cone surface.

A cutter element or insert 100 is shown in FIGS. 3-6 and is believed to have particular utility when employed as an inner row or bottomhole cutter element, such as in inner rows 81*a* or 82*a* shown in FIGS. 1 and 2 above. However, insert 100 may also be employed in other rows and other regions on the cone cutter, such as in heel row 60*a* and/or gage rows 70*a*, 70*b* shown in FIGS. 1 and 2.

Figure 4:
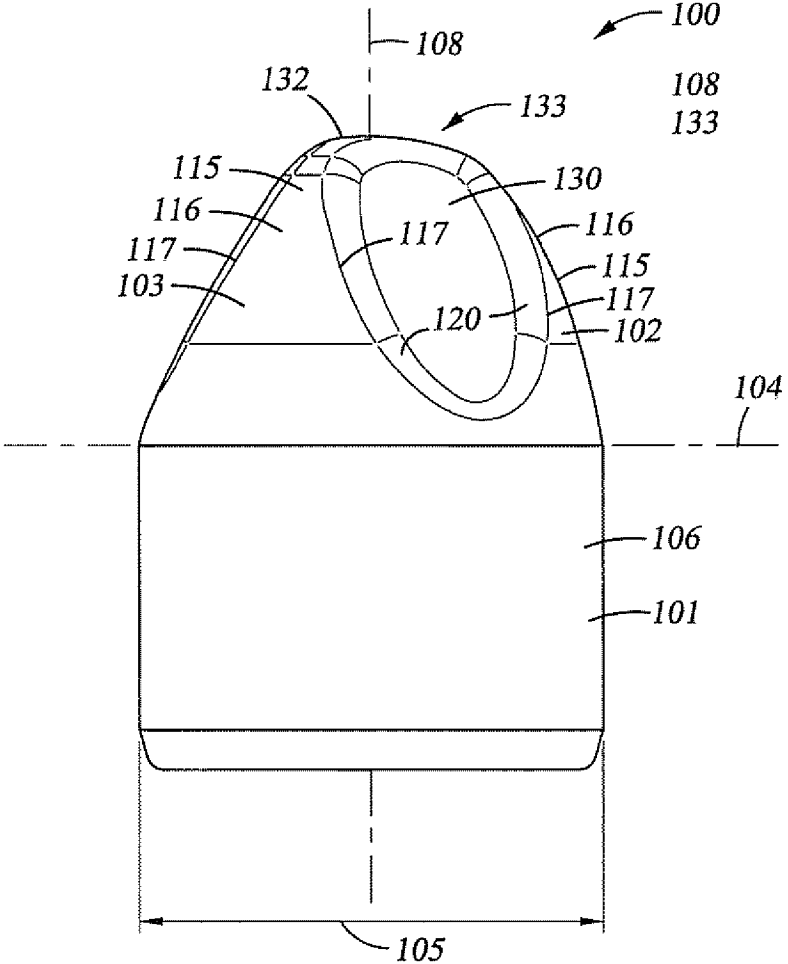
FIG. 4 is a front elevation view of the insert of FIG. 3.
Figure 3:
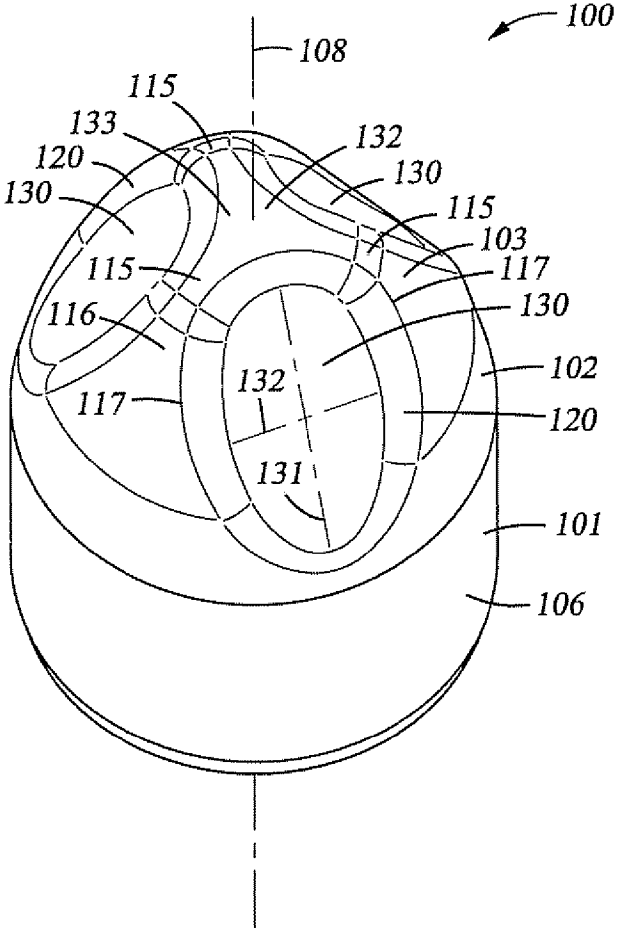
FIG. 3 is a perspective view of an embodiment of an insert suitable for use in the drill bit of FIG. 1.
Figure 5:
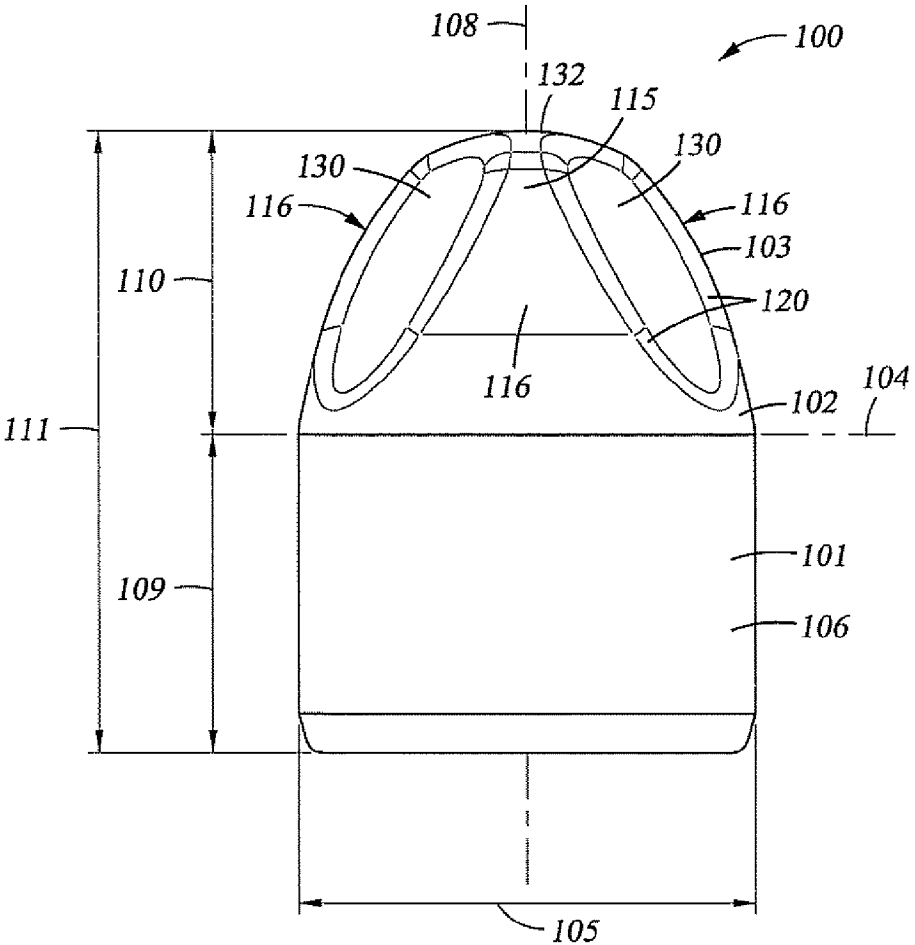
FIG. 5 is a side elevation view of the insert of FIG. 3.

Referring now to FIGS. 3-6, insert 100 having a central axis 108 is shown to include a base portion 101 and a cutting portion 102 extending therefrom. Cutting portion 102 includes a continuously contoured cutting surface 103 extending from a reference plane of intersection 104 that divides base portion 101 and cutting portion 102. Cutting surface 103 has a generally curved frustoconical profile as best seen in the side and front profile views perpendicular to insert axis 108 (FIGS. 4 and 5). Although cutting portion 102 and base portion 101 share a common central axis 108 in the embodiment illustrated in FIGS. 3-6, in different embodiments (not illustrated), base portion 101 may have a base axis and cutting portion 102 may have a cutting axis that is different from the base axis. In such embodiments, the base axis and cutting axis may be parallel, but laterally offset from one another. Alternatively, the base axis and cutting axis may not be parallel and instead be oriented at some acute angle relative to one another. For example, in an embodiment, cutting portion 102 may be tilted to the side such that a portion of cutting portion 102 extends laterally beyond the side surface of base portion 101.

Cutting surface 103 includes an apex 132 that represents the upper most point on cutting surface 103. In this embodiment, axis 108 intersects and passes through apex 132. Thus, as used herein, the term "apex" may be used to refer to the point or surface on the cutting surface of a cutter element that is farthest from the base portion of the cutter element measured parallel to the insert axis. Although determination of the apex is made with respect to axial measurement parallel to the insert axis, the apex of a cutting surface need not lie on the insert axis.

Figure 6:
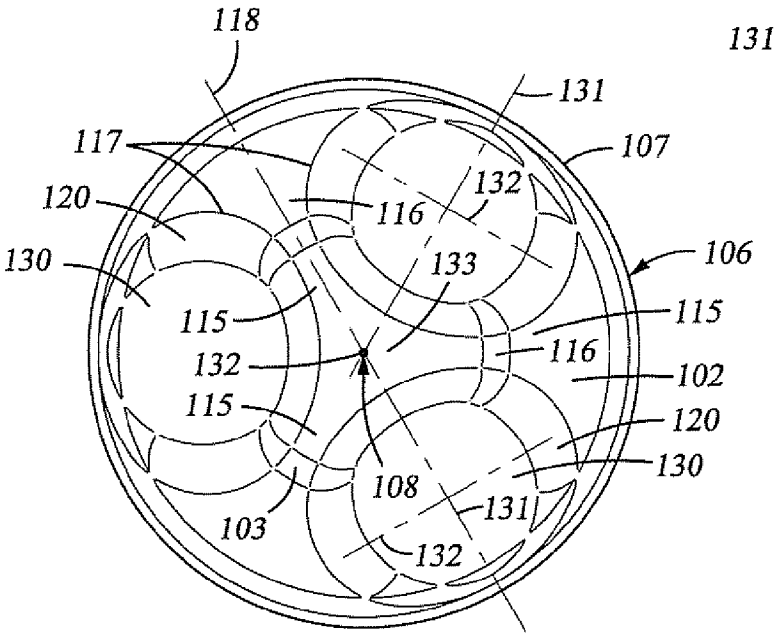
FIG. 6 is a top view of the insert of FIG. 3.

In this embodiment, base portion 101 is generally cylindrical, having diameter 105, central axis 108, and a cylindrical outer surface 106 defining an outer circular profile or footprint 107 of insert 100 (FIG. 6). As best shown in FIG. 5, base portion 101 has a height 109, and cutting portion 102 extends from base portion 101 to apex 132 so as to have an extension height 110. Collectively, base portion 101 and cutting portion 102 define the overall height 111 of insert 100. Although base portion 101 is shown as cylindrical, it should be appreciated that base portion 101 may alternatively be formed in a variety of shapes including, without limitation, oval, rectangular, triangular, etc. As is conventional in the art, base portion 101 is preferably retained within a rolling cone cutter by an interference fit, or by other means, such as brazing or welding, such that cutting portion 102 and cutting surface 103 extend beyond the cone steel. Once mounted, the extension height 110 of cutter element 100 generally defines the distance from the cone surface to the outermost point or apex 132 of cutting surface 103 as measured parallel to the insert's axis 108. Thus, as used herein, the term "extension" and "extension height" may be used to refer to the axial length of the extension of a cutting portion beyond the cone steel.

Referring still to FIGS. 3-6, three continuously contoured wear relief grooves or depressions 130 are provided in cutting surface 103. As used herein, the term "continuously contoured" may be used to describe surfaces that are smoothly and continuously curved so as to be free of sharp edges and transitions having small radii (0.08 in. or less). In this embodiment, depressions 130 are concave or inwardly bowed relative to insert axis 108. Further, depressions 130 are spaced apart such that they do not contact or intersect each other. As will be explained in more detail below, although three depressions 130 are provided in the embodiment illustrated in FIGS. 3-6, in general, insert 100 may include any suitable number of depressions including, without limitation, one, two, four or more.

In this embodiment, each depression 130 has substantially the same geometry (e.g., same size, shape, depth, etc.). Specifically, each depression 130 has a generally ovoid shape defined by a major axis 131 and a minor axis 132. It should be understood that the length of each depression 130 is measured along major axis 131, and the width of each depression 130 is measured along minor axis 132. Further, each depression 130 has substantially the same depth. In general, the deeper the depth of depressions 130, the more aggressive cutting face 103, and the shallower the depth of depressions 130, the less aggressive cutting face 103.

Depressions 130 are disposed in cutting surface 103 at locations between base portion 102 and apex 132, but preferably do not fully extend to base portion 102 or apex 132. In this embodiment, each depression 130 is positioned equidistant from axis 108. Further, depressions 130 are angularly spaced a uniform 120° apart and oriented such that the projections of their major axes 131 intersect insert axis 108, as best shown in FIG. 6. As will be shown and described in more detail below, although depressions 130 are illustrated in FIGS. 3-6 as having the same geometry (e.g., size, shape, depth, etc.), the same position, and uniform angular spacing about insert axis 108, in different embodiments, one or more depressions 130 may have a different geometry (e.g., different size, shape, depth, etc.), a different position on the cutting surface, non-uniform angular spacing about insert axis 108, or combinations thereof.

Referring still to FIGS. 3-6, cutting surface 103 further comprises three raised ridges or ribs 115. Each rib 115 radiates from apex 132 and extends towards base portion 102. In this embodiment, each rib 115 extends fully to base portion 102. Each rib 115 is positioned between and extends at least partially around two adjacent depressions 130.

Ribs 115 may also be described as intersecting and contiguous with each other proximal apex 132, thereby forming a tip 133 on cutting surface 103. Thus, tip 133 is generally defined by the intersection of ribs 115 proximal apex 132. As best shown in the side and front profile views of FIGS. 4 and 5, respectively, tip 133 is generally rounded. It should be understood that a "profile view" of an insert is a view of an insert perpendicular to the insert axis (e.g., front view or side view). As distinguished from a "profile view", an "axial view"

is a view of an insert along the inserts axis (e.g., top axial view). In general, the size of tip 133 will vary depending upon numerous factors, including formation characteristics such as hardness, intended weight-on-bit, and other features associated with the particular bit and cutting structure design. The smoothly rounded shape of tip 133 enhances its ability to resist chipping and fractures.

Similar to depressions 130, ribs 115 are angularly spaced a uniform 120° apart. As will be explained in more detail below, although three ribs 115 are provided in the embodiment illustrated in FIGS. 3-6, in general, insert 100 may include any suitable number of ribs including, without limitation, one, two, four or more. However, insert 100 preferably has the same number of ribs and depressions (e.g., three ribs and three depressions, two ribs and two depressions, etc.). In general, ribs 115 provide a relatively aggressive cutting surface 103 (as compared to a conventional dome-shaped inserts), and also help to support and buttress tip 133 during impact with the uncut formation.

Each rib 115 includes a continuously contoured outer surface 116 (best seen in side and front profile views of FIGS. 4 and 5) and non-linear or arcuate lateral sides 117 (best seen in the top axial view of FIG. 6). In this embodiment, outer surface 116 of each rib 115 is convex or outwardly bowed relative to insert axis 108, although outer surface 116 of one or more ribs 115 may be planar or concave in different embodiments. In addition, in this embodiment, lateral sides 117 may be described as concave or inwardly bowed relative to centerline 118 of rib 115 (FIG. 6). Lateral sides 117 define the shape and periphery of each rib 115. In this embodiment, lateral sides 117 are mirror images of each other. As will be shown and described in more detail below, although ribs 115 are illustrated in FIGS. 3-6 as having the same geometry (e.g., size and shape), the same position, and uniform angular spacing about insert axis 108, in different embodiments, one or more ribs 115 may have a different geometry (e.g., different size and/or shape), a different position on the cutting surface, non-uniform angular spacing about insert axis 108, or combinations thereof.

Figure 7:
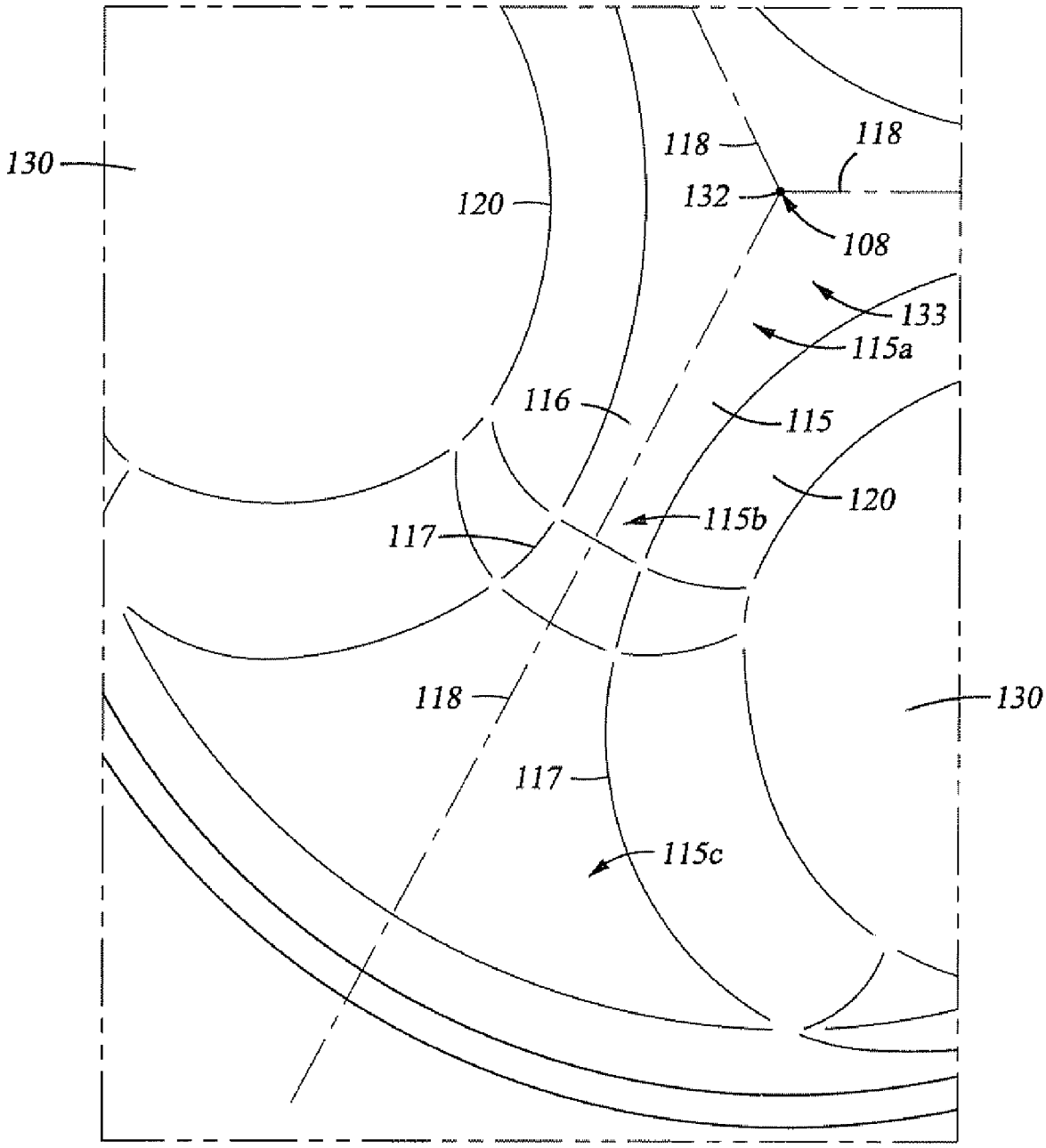
FIG. 7 is a partial enlarged top view of a rib of the insert of FIG. 3.

Referring briefly to FIGS. 6 and 7, each rib 115 has a centerline 118 that is substantially linear as viewed from the top along insert axis 108. Centerline 118 of each rib 115 is generally centered between lateral sides 117. It should be understood that the length of each rib 115 is measured along rib axis 118 from apex 132 to plane of intersection 104, while the width of each rib 115 is measured perpendicular to rib axis 118 along outer surface 116 between lateral sides 117. In addition, in this embodiment, each rib 115 is oriented such that its centerline 118 intersects insert axis 108. Although ribs 115 are sized and positioned such that the centerline of each is linear and has a projection intersecting insert axis 108, in different embodiments, one or more rib may have an arcuate centerline, may not have a centerline with a projection that intersects the insert axis, or combinations thereof. For instance, in some embodiments, one or more rib (e.g., rib 115) may spiral about the cutting portion.

Referring again to FIGS. 3-6, cutting surface 103 includes transition surfaces between each rib 115 and each depression 130 to reduce detrimental stresses. More particularly, cutting surface 103 includes a radiused rib-to-depression transition surface 120 to blend cutting surface 103 between each rib 115 and each depression 130 on cutting surface 103. Transition surfaces 120 extend between ribs 115 and depressions 130 and smoothly blend cutting surface 103 between lateral sides 117 and depressions 130 and between tip 133 and depressions 130.

Referring now to FIG. 7, moving from apex 132 towards base portion 101, each rib 115 may be described as comprising a first or upper rib section 115*a* proximal apex 132, a second or intermediate rib section 115*b* disposed laterally between depressions 130, and a third or lower rib section 115*c* extending to base portion 101. Thus, second rib section 115*b* is positioned between first rib section 115*a* and third rib section 115*c*.

First rib section 115*a* of each rib 115 forms a portion of insert tip 133 and extends at least partially around the upper portion of each adjacent depression 130. In other words, first rib section 115*a* extends at least partially around the portion of each adjacent depression 130 that is proximal tip 133 and distal base portion 101. First rib sections 115*a* of each rib 115 intersects and are contiguous at tip 133. Third rib section 115*c* intersects base portion 101 at plane of intersection 104 and extends at least partially around the lower portion of each adjacent depression 130. In other words, third rib section 115*c* extends at least partially around the portion of each adjacent depression 130 that is distal tip 133 and proximal base portion 101. The third rib section 115*c* of each rib 115 intersects and is contiguous with the third rib section 115*c* of each adjacent rib 115 proximal base portion 101. Thus, first rib section 115*a* of each rib 115 intersects the first rib section 115*a* of a different rib 115 at tip 133 between apex 132 and depression 130, and the third rib section 115*c* of each rib 115 intersects the third rib section 115*c* of a different rib 115 proximal base portion 101 between depression 130 and plane of reference 104.

In general, second rib section 115*b* has a width, measured as previously described, that is less than the width of first rib section 115*a* and third rib section 115*c*. In other words, second rib section 115*b* forms the narrowest part of rib 115. It should be appreciated that rib sections 115*a-c* are contiguous, smoothly connected, and preferably integral.

It should be appreciated that the geometry of depressions 130 may impact the geometry of ribs 115 and vice versa. In general, larger depressions 130 result in thinner, more aggressive ribs 115, while smaller depressions 130 result in wider, less aggressive ribs 115. Likewise, deeper depressions 130 result in more pronounced, more aggressive ribs 115, while shallower depressions 130 result in less pronounced, less aggressive ribs 115. However, without being limited by this or any particular theory, more aggressive ribs 115 offer the potential for enhanced formation removal and ROP, while less aggressive ribs offer the potential for a more durable and robust insert 100. In some embodiments, the depth of one or more depressions 130 may be varied to optimize the cutting effectiveness of insert 100.

In the embodiment illustrated in FIGS. 3-6, both depressions 130 and ribs 115 are uniformly shaped, sized, and positioned. In addition, since both depressions 130 and ribs 115 are uniformly angularly spaced about axis 108 and generally equidistant from apex 132, cutting portion 102 may also be described as axisymmetric (i.e., symmetric relative to axis 108).

As mentioned above, cutting surface 103 is preferably a continuously contoured surface. Although certain reference or contour lines are shown in FIGS. 3-6 to represent general transitions between one surface and another, it should be understood that the lines do not represent sharp transitions. Instead, all surfaces are preferably blended together to form the preferred continuously contoured surfaces and cutting profiles that are free from abrupt changes in radius. By eliminating small radii along cutting surface 103, detrimental stresses in the cutting surface are substantially reduced, leading to a durable and long lasting cutter element.

Many conventional dome-shaped inserts employed as inner row or bottomhole cutter elements include a more rounded cutting surface and a relatively large volume of insert material in their cutting portion extending from the cone steel as compared to conventional more aggressive chisel-shaped inserts. Consequently, dome-shaped inserts are less likely to chip and/or fracture during engagement with the formation material, and also more abrasion resistant. However, being less aggressive than conventional chisel-shaped inserts, dome-shaped inserts are generally less effective at piercing and penetrating the formation, and typically result in lower ROP. To the contrary, many conventional chisel-shaped inserts are relatively sharp and aggressive as compared to conventional dome-shaped inserts. Consequently, such chisel-shaped inserts are generally more effective at penetrating the formation and removing formation material, and thus, typically result in higher ROPs. However, such conventional aggressive inserts have less insert material in their cutting portions, and are thus less abrasion resistant and more fracture prone. Further, many chisel-shaped inserts include sharp edges that are more susceptible to chipping and/or fracture. Embodiments of the insert described herein (e.g., insert 100) provide a compromise between more aggressive conventional bottomhole inserts (e.g., chisel-shaped inserts) sometimes susceptible to premature chipping, fracturing and abrasive wear, and the less aggressive, more robust conventional dome-shaped bottomhole inserts.

Even though cutting surface 103 of insert 100 is generally contoured, the presence of ribs 115 on cutting surface 103 results in a relatively aggressive insert 100 as compared to most conventional dome-shaped inner row inserts. Specifically, ribs 115 present a reduced surface area region on cutting surface 103 for engaging the uncut formation. Without being limited by any particular theory or present belief, for a given force applied to an insert, the contact pressure applied to the formation via the cutting surface of the insert will increase as the surface area of the insert contacting the formation is decreased; in general, a greater contact pressure will result in more effective penetration into the formation and formation removal. Without being limited by any particular theory or present belief, it is anticipated that providing ribs 115 will provide insert 100 with the ability to penetrate deeply without the requirement of adding substantial additional weight-on-bit to achieve that penetration. Consequently, embodiments of the inserts described herein (e.g., insert 100) are believed to offer the potential for increased ROP as compared to many conventional dome-shaped inserts.

However, on the other hand, the continuously contoured cutting surface (e.g., cutting surface 103) of the embodiments described herein are believed to offer the potential to reduce the likelihood of chipping and fracturing as compared to many conventional aggressive inserts (e.g., chisel-shaped inserts). In particular, the curved shaped and smooth surfaces of depressions 130, ribs 115, and transition surfaces 120 eliminate relatively sharp corners and edges that are typical in some sharp chisel-shaped inner row inserts and which have a greater tendency to prematurely chip and/or fracture as the insert impacts and gouges of the formation material. Consequently, as compared to some conventional aggressive inner row inserts having sharp points and cutting edges (e.g., chisel-shaped inserts), embodiments of the inserts described herein (e.g., insert 100) are believed to offer the potential for an inner row cutter element with a reduced likelihood of chipping and/or fracturing.

In addition, the geometry of the cutting portion of the embodiments of the inserts described herein (e.g., insert 100) are believed to offer the potential for a more robust and abrasion resistant insert as compared to certain conventional aggressive inner row inserts (e.g., chisel-shaped inserts). In general, with all other parameters being equal, less insert material means a less robust and less durable cutter element. Inserts with less insert material are generally less able to resist impact loads (e.g., thinner inserts are more susceptible to breakage), and the less able to resist abrasion (e.g., there is less material to be worn away). In many conventional aggressive inner row inserts have planar sides or flanks that taper to a relatively thin, sharp crest (e.g., chisel-shaped insert). As a result of the planar tapered sides, the amount or volume of insert material decreases linearly moving from the base towards the crest. Although insert 100 generally tapers from a relatively wide base portion 101 to a more narrow tip 133, a substantial volume of insert material is nevertheless provided near tip 133 as compared to certain conventional aggressive inner row cutter elements. Specifically, insert 100 has a cutting surface 103 with a parabolic profile when viewed from the side and front perpendicular to insert axis 108 as best seen in FIGS. 4 and 5. As a result, cutting portion 102 includes an increased volume of insert material, and consequently, insert 100 offers the potential for a more robust and durable cutting element (e.g., insert 100) with a reduced wear rate during drilling.

Still further, in many conventional aggressive inner row inserts, such as chisel-shaped inserts, as the insert is worn and/or chips, the insert generally becomes dull and less aggressive, thereby reducing formation removal and ROP. Specifically, as the chisel-shaped insert is worn, the cutting surface of the insert becomes rounded off and the surface area of the insert presented to the formation material increases. The rounding of the cutting surface is especially a concern in harder formations where abrasion can quickly wear an aggressive insert. However, the presence of concave depressions 130 in cutting surface 103, offer the potential for an insert 100 better able to maintain its aggressiveness even after moderate wear. Without being limited by this or any particular theory, it is believed that as insert 100 is worn down, the cutting surface shape and cross-sectional area presented to the uncut formation are generally maintained and do not change drastically. Consequently, embodiments of insert 100 are believed to offer the potential for an insert that maintains is aggressiveness even after moderate wear.

Figure 9:
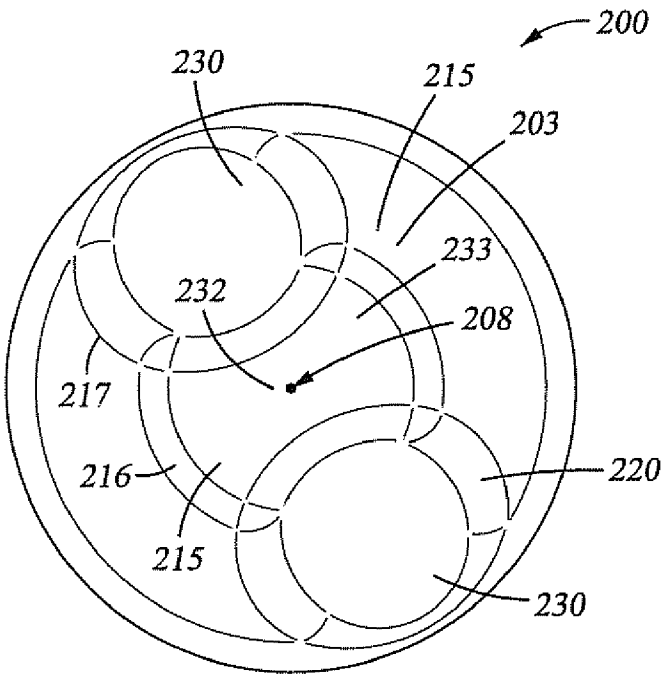
FIG. 9 is a top view of the insert of FIG. 8.
Figure 8:
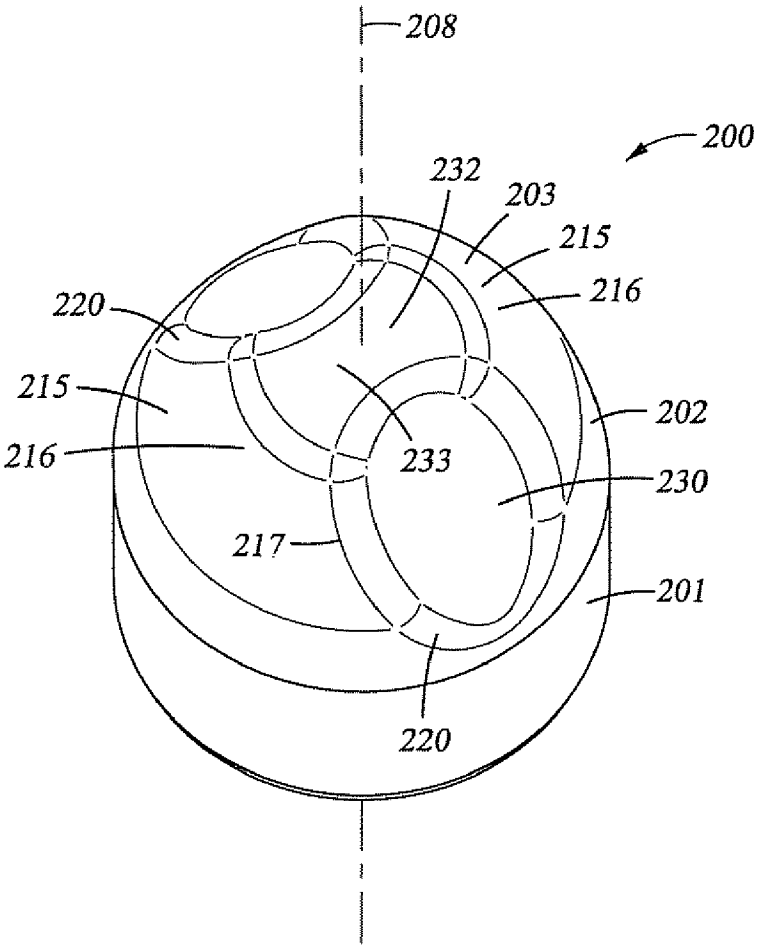
FIG. 8 is a perspective view of another embodiment of an insert suitable for use in the drill bit of FIG. 1.

Referring now to FIGS. 8 and 9, another embodiment of a cutter element or insert 200 believed to have particular utility when employed as an inner row or bottomhole cutter element, such as in inner rows 81*a* or 82*a* shown in FIGS. 1 and 2 above is shown. However, insert 200 may also be employed in other rows and other regions on the cone cutter, such as in heel row 60*a* and/or gage rows 70*a*, 70*b* shown in FIGS. 1 and 2.

Similar to insert 100 previously described, insert 200 comprises a central axis 208, a generally cylindrical base portion 201, and a cutting portion 202 extending therefrom. Cutting portion 202 includes a cutting surface 203 with an apex 232. However, cutting surface 203 of insert 200 includes two continuously contoured depressions 230 and two continuously contoured ribs 215, generally blended together by radiused transition surfaces 220.

Depressions 230 are generally concave and positioned between base portion 202 and apex 232, but do not fully extend to base portion 202 or apex 232, and are spaced a uniform 180° apart about axis 208. Further, each depression 230 has substantially the same geometry (e.g., same size and shape). Specifically, each depression 230 has a generally ovoid shape.

Referring still to FIGS. 8 and 9, each rib 215 radiates from apex 232 towards base portion 202. In this embodiment, each rib 215 extends completely between apex 232 and base portion 202. In particular, ribs 215 meet proximal apex 232 to form a tip 233. Each rib 215 is positioned between and extends at least partially around two adjacent depressions 130 as previously described. Similar to depressions 230, ribs 215 are angularly spaced a uniform 180° apart. Moving around the outer periphery of cutting surface 203, ribs 215 and depressions 230 form an alternating pattern with one rib 215 between each pair of depressions 230, and one depression 230 between each pair of ribs 215. As previously described, ribs 215 provide a relatively aggressive cutting surface 103 as compared to most conventional dome-shaped inserts.

In addition, each rib 215 includes a continuously contoured convex outer surface 216 and arcuate lateral sides 217. Radiused transition surfaces 220 smoothly blend lateral sides 217 of each rib 215 into depressions 220 to reduce detrimental stresses in cutting portion 202. The generally frustoconical profile of cutting surface 202 of insert 200 and the convex ribs 215 tend to enhance the volume or amount of insert material within cutting portion 202.

Figure 11:
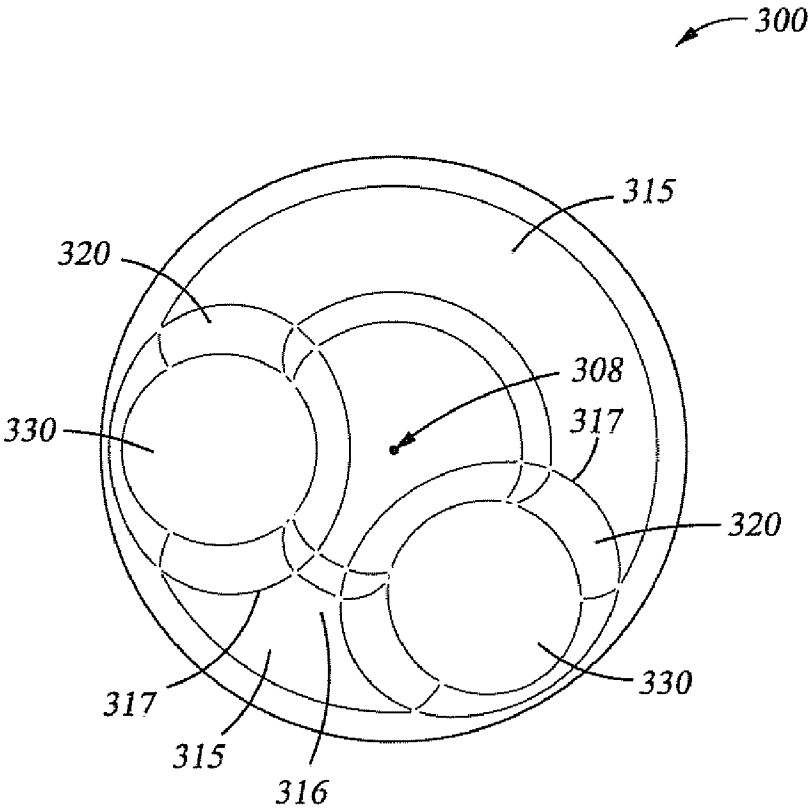
FIG. 11 is a top view of the insert of FIG. 10.
Figure 10:
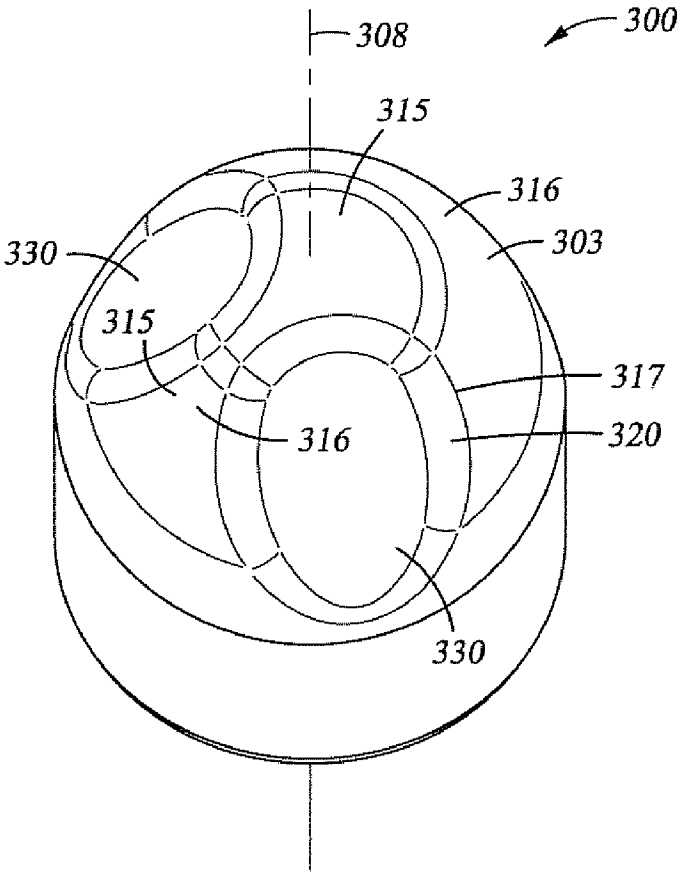
FIG. 10 is a perspective view of another embodiment of an insert suitable for use in the drill bit of FIG. 1.

Referring now to FIGS. 10 and 11, another embodiment of a cutter element or insert 300 believed to have particular utility when employed as an inner row or bottomhole cutter element, such as in inner rows 81*a* or 82*a* shown in FIGS. 1 and 2 above is shown. Insert 300 is substantially the same as insert 200 previously described, however, the cutting surface 303 of insert 300 includes two continuously contoured concave depressions 330 non-uniformly angularly spaced about insert axis 308. Specifically, rather than being spaced apart a uniform 180° (i.e., generally opposite one another), the two depressions 330 are angularly spaced apart by 120°. Consequently, this embodiment of insert 300 is not axisymmetric.

Contoured ribs 315 are angularly spaced apart a uniform 180°, but have different sizes. In particular, although ribs 315 each have a convex outer surface 316 and arcuate lateral sides 317, and hence similar shapes, ribs 315 have different widths. One rib 315 positioned in the 120° gap between depressions 330 is thinner than the other rib 315 positioned in the 240° gap between depressions 330.

Figure 13:
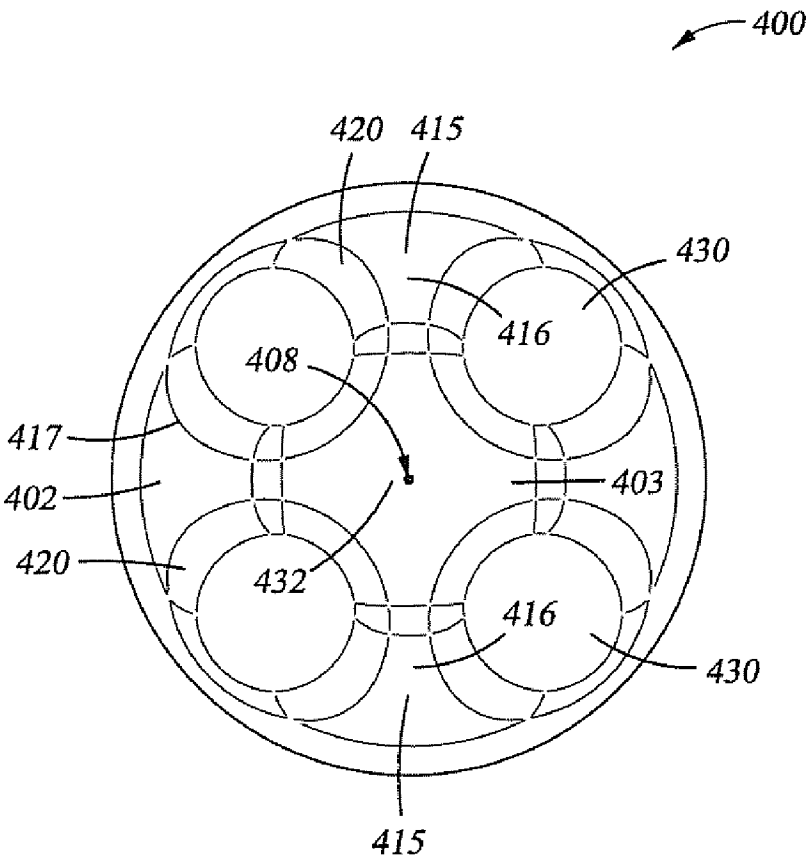
FIG. 13 is a top view of the insert of FIG. 12.
Figure 12:
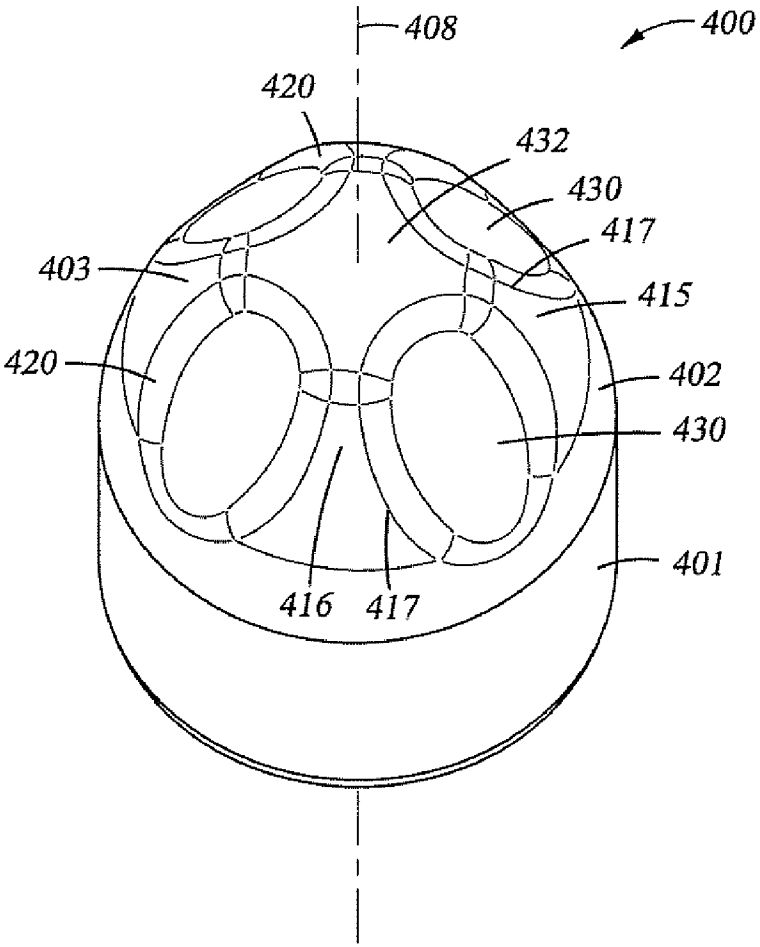
FIG. 12 is a perspective view of another embodiment of an insert suitable for use in the drill bit of FIG. 1.

Referring now to FIGS. 12 and 13, another embodiment of a cutter element or insert 400 believed to have particular utility when employed as an inner row or bottomhole cutter element. Similar to inserts 100, 200 previously described, insert 400 comprises a central axis 408, a generally cylindrical base portion 401, and a cutting portion 402 extending therefrom. Cutting portion 402 includes a cutting surface 403 with an apex 432. However, cutting surface 403 of this embodiment of insert 400 includes four continuously contoured depressions 430 and four continuously contoured ribs 415, generally blended together by radiused transition surfaces 420.

Depressions 430 are concave and positioned between base portion 402 and apex 432, but do not fully extend to base portion 402 or apex 432, and ribs 415 radiate from apex 432 and extends to base portion 402. Each rib 415 includes a continuously contoured convex outer surface 416 and non-linear lateral sides 417. Radiused transition surfaces 420 smoothly blend lateral sides 417 of each rib 415 into depressions 420 to reduce detrimental stresses in cutting portion 402. However, since this embodiment includes four depressions 430 and four ribs 415 that are uniformly angularly spaced, ribs 415 are generally angularly spaced 90° apart and depressions 430 are also angularly spaced 90° apart.

Figure 14:
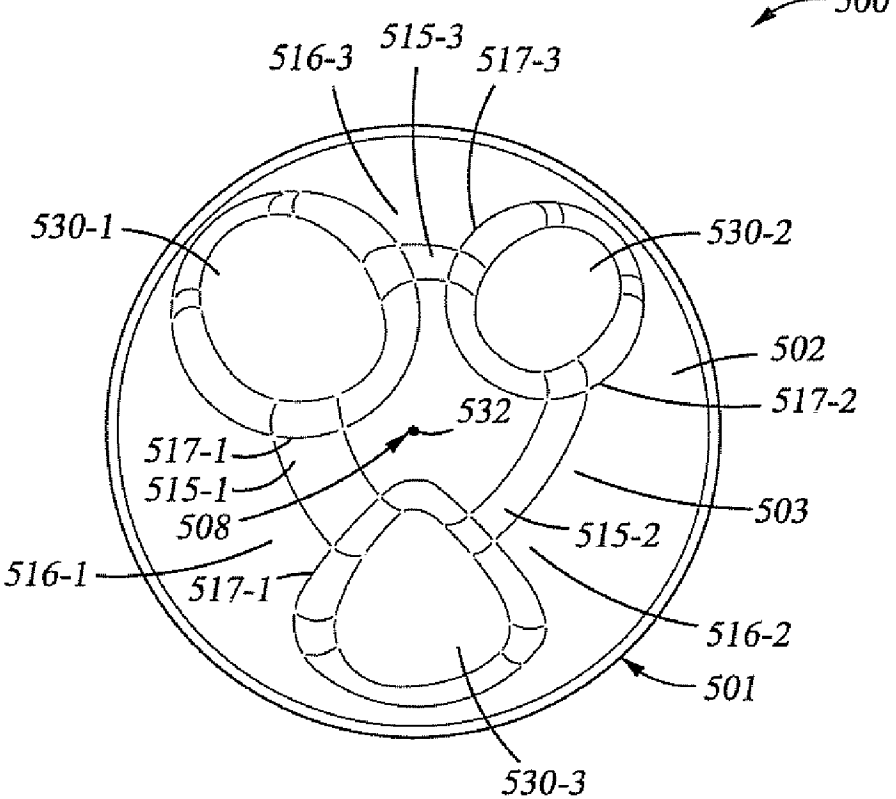
FIG. 14 is a top view of another embodiment of an insert suitable for use in the drill bit of FIG. 1.

Although inserts 100, 200 previously described comprise depressions 130, 230, respectively, and ribs 115, 215, respectively, of substantially the same geometry (e.g., size and shape), orientation, and angular spacing, other embodiments constructed in accordance with the principles described herein may include one or more depressions and/or ribs of differing geometry, orientation, and/or positioning, yet still offer the potential for the benefits described above. For instance, referring now to FIG. 14, an insert 500 comprises an insert axis 508, a base portion 501, and a cutting portion 502 having a cutting surface 503. Cutting surface 503 has an apex 532 and includes three angularly spaced apart contoured depressions 530-1, 530-2, 530-3 and three angularly spaced apart ribs 515-1, 515-2, 515-3; one rib 515-1, 515-2, 515-3 is provided between each pair of depressions 530-1, 530-2, 530-3 (e.g., rib 515-1 is positioned between depressions 530-1 and 530-3). Similar to the embodiments previously shown and described, ribs 515-1, 515-2, 515-3 radiate from apex 532, extend to base portion 501, and at least partially enclose depressions 530-1, 530-2, 530-3. Further, ribs 515-1, 515-2, 515-3 each include a contoured convex outer surface 516-1, 516-2, 516-3, respectively, and non-linear lateral sides 517-1, 517-2, 517-3, respectively.

However, every depression 530-1, 530-2, 530-3 does not have the same geometry, orientation, and angular spacing, and further, every rib 515-1, 515-2, 515-3 does not have the same geometry, orientation, and angular spacing. Rather, in this insert embodiment, depression 530-3 has a generally triangular shape with curved sides and curved transitions between the sides, while depressions 530-1 and 530-2 both have ovoid shapes. In addition, although depressions 530-1 and 530-2 have similar shapes, depression 530-1 is larger than depression 530-2 and positioned closer to apex 532. Still further, depressions 530-1, 530-2, 530-3 are non-uniformly angularly spaced about insert axis 508. Specifically, depressions 530-1 and 530-2 are angularly spaced about 90° apart, while depression 530-3 is angularly spaced about 135° from each of depression 530-1, 530-2.

Likewise, although each rib 515-1, 515-2, 515-3 has a convex outer surface 516-1, 516-2, 516-3, respectively, and generally arcuate lateral sides 517-1, 517-2, 517-3, respectively, as previously described, ribs 515-1, 515-2, 515-3 generally have different geometries (e.g., size and shapes). For instance, rib 515-2 is wider than rib 515-1, which is wider than rib 515-3. In addition, ribs 515-1, 515-2, 515-3 are non-uniformly angularly spaced about axis 508. As a result of the non-uniform geometry, orientation, and positioning of depressions 530-1, 530-2, 530-3 and ribs 515-1, 515-2, 515-3, the cutting portion 502 and cutting surface 503 of insert 500 are not axisymmetric.

Figure 15:
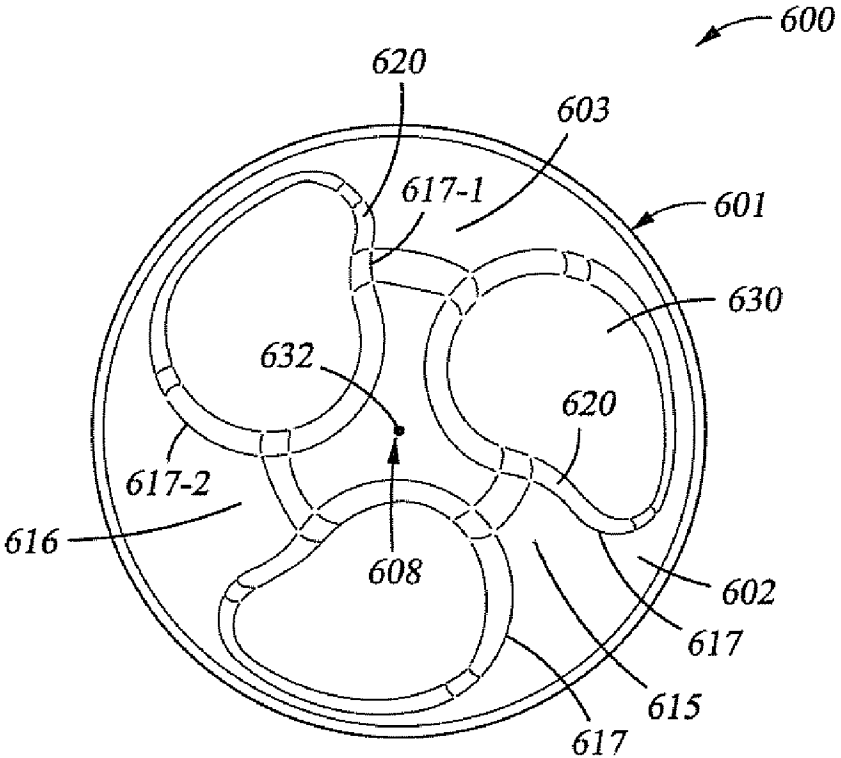
FIG. 15 is a top view of another embodiment of an insert suitable for use in the drill bit of FIG. 1.

Referring now to FIG. 15, another embodiment of a cutter element or insert 600 believed to have particular utility when employed as an inner row or bottomhole cutter element. Similar to inserts 100, 200 previously described, insert 600 comprises a central axis 608, a generally cylindrical base portion 601, and a cutting portion 602 extending therefrom. Cutting portion 602 includes a cutting surface 603 with an apex 632. Cutting surface 603 includes three ribs 615 spaced apart by three continuously contoured depressions 630. In particular, ribs 615 and depressions 630 are blended together by radiused transition surfaces 620.

Depressions 630 are concave and positioned between base portion 602 and apex 632, but do not fully extend to base portion 602 or apex 632, and ribs 615 radiate from apex 632 and extends towards base portion 602. Each rib 615 includes a continuously contoured outer surface 616 that is convex in profile view. In addition, each rib 615 includes lateral sides 617 that are curved or arcuate. However, lateral side 617 for a given rib 615 are not identical. For instance, lateral side 617-1 shown on the right side of the upper left depression 630 has an S-shape, while lateral side 617-2 shown on the left side of the upper left depression 630 has a semi-circular shape. Radiused transition surfaces 620 smoothly blend lateral sides 617 of each rib 615 into depressions 620 to reduce detrimental stresses in cutting portion 602.

Figure 16:
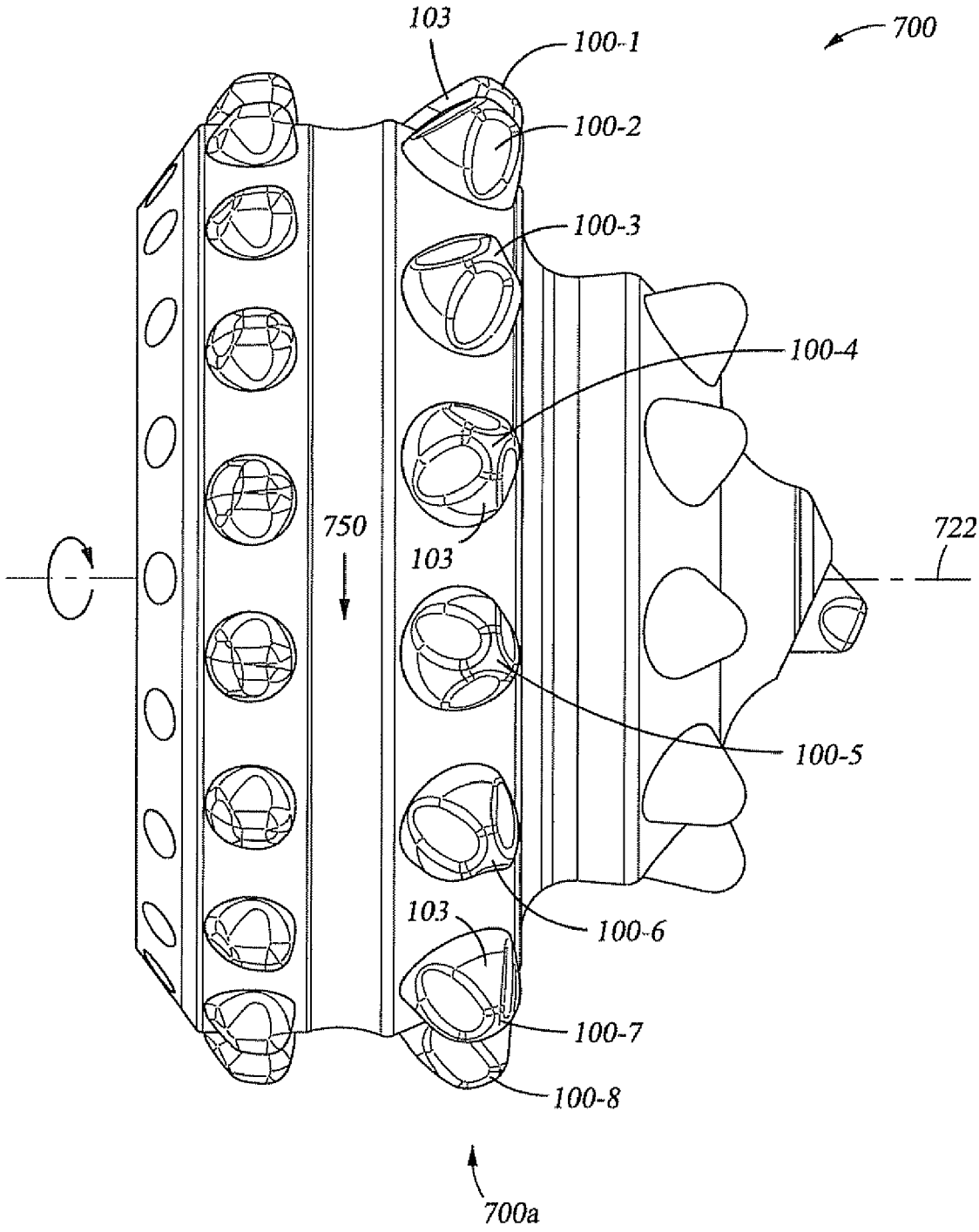
FIG. 16 is a side view of a cone cutter including the insert of FIG. 3.
Figure 17:
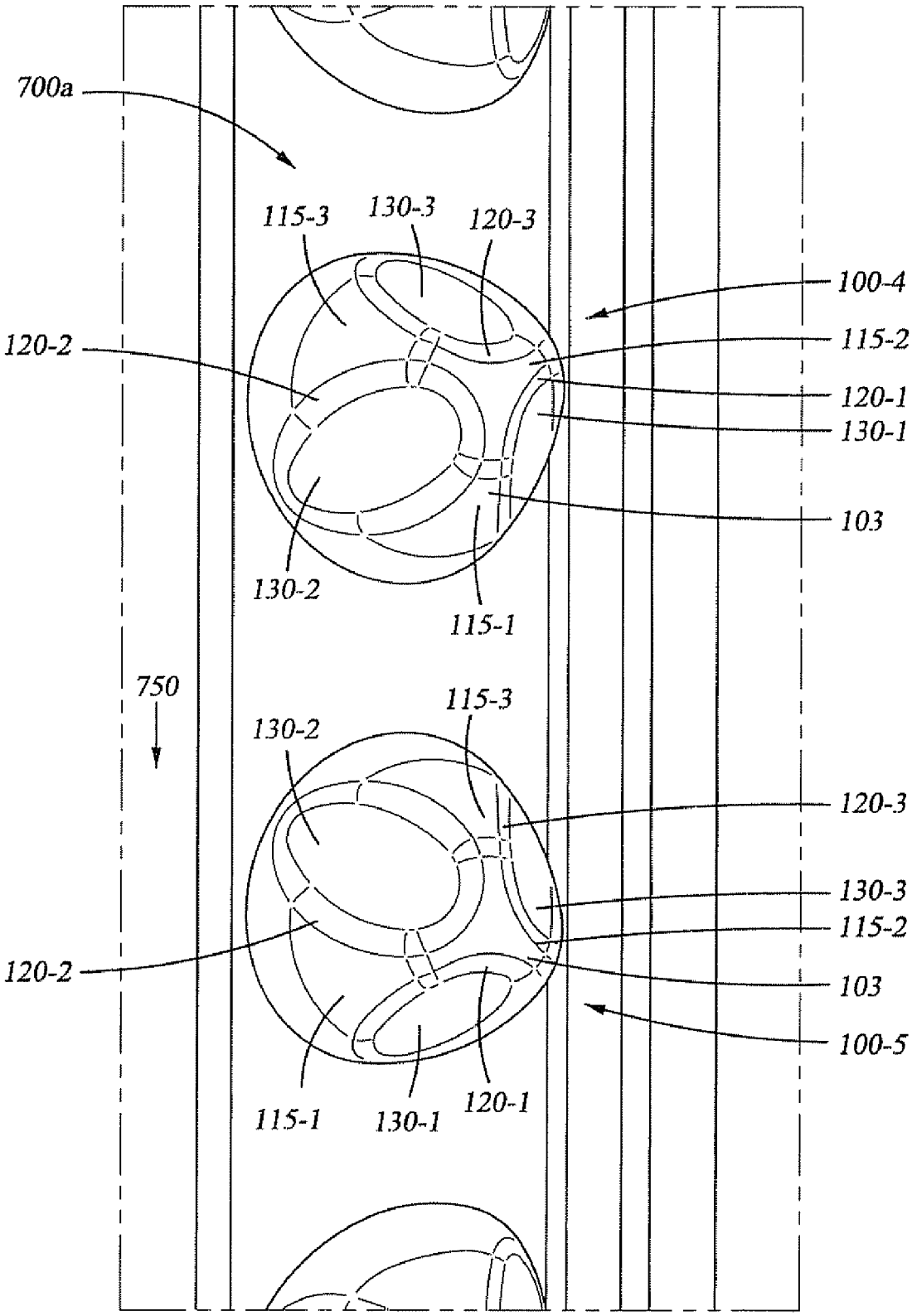
FIG. 17 is a partial enlarged view of certain cutter elements mounted to the cone cutter of FIG. 16.

Referring now to FIGS. 16 and 17, insert 100 previously described is shown mounted in a rolling cone cutter 700 as may be employed, for example, in the bit 10 described above with reference to FIGS. 1 and 2, with cone cutter 700 substituted for any of the cones 1-3 previously described. As shown, cone cutter 700 has an axis of rotation 722 and includes a plurality of inserts 100 disposed in a circumferential inner row 700*a*. Inserts 100 may be positioned in rows of cone cutter 700 in addition to or other than inner row 700*a*. For purposes of further explanation, inserts 100 of row 700*a* are assigned reference numerals 100-1 through 100-14, there being fourteen inserts 100 in row 700*a* in this embodiment (only inserts 100-1 through 100-8 are shown in this side view of cone 700). In addition, depressions 130, ribs 115, and transition surfaces 120 are assigned reference numerals 130-1 through 130-3, 120-1 through 120-3, and 115-1 through 115-3, respectively, there being three depressions 130, three transitions surfaces 120, and three ribs 115 for each insert 100 (FIG. 17).

In this embodiment, a plurality of inserts 100-1 through 100-14 of circumferential row 700*a* are oriented differently in cone 700 in order to vary the portion of cutting surface 103 that first impacts the formation. In general, the orientation of inserts 100-1 to 100-14 in cone 700 may be varied for any suitable reason including, without limitation, to increase bottom-hole coverage, to increase the number of fracture planes created in the uncut formation upon impact, to enhance cutting effectiveness in a particular type of formation, or combinations thereof. For instance, the orientation of one, two, or more inserts 100-1 to 100-14 may be varied to optimize cutting in a softer or harder formation.

Referring specifically to inserts 100-4 and 100-5 for example, as cone 160 rotates about cone axis 722 in the direction of arrow 750, insert 100-5 is positioned with depression 130-1 substantially perpendicular to the direction of rotation 750 and on the leading side of insert 100-5 (i.e., on the side of insert 100-1 that will first impact the formation). As a result, depression 130-1 and transition surface 120-1 of insert 100-5 will first impact the formation followed by ribs 115-1, 115-2. However, immediately trailing insert 100-4 (i.e., the next insert 100 to engage the uncut formation following insert 100-5) is positioned with outer surface 116 of rib 115-1 substantially perpendicular to the direction of rotation 750 and on the leading side of insert 100-4. Consequently, outer surface 116 of rib 115-1 will first impact the formation followed by transition surfaces 120-1, 120-2 and depressions 130-1, 130-2. Without being limited by this or any particular theory, the relatively smaller surface area of rib 115-1 of 100-4 results in a more aggressive impact and cutting action on the uncut formation than the relatively larger surface area of depression 130-1 of insert 100-5.

As understood by those in the art, the phenomenon by which formation material is removed by the impacts of cutter elements is extremely complex. The geometry and orientation of the cutter elements, the design of the rolling cone cutters, the type of formation being drilled, as well as other factors, all play a role in how the formation material is removed and the rate that the material is removed (i.e., ROP). Depending upon their location in the rolling cone cutter, cutter elements have different cutting trajectories as the cone rotates in the borehole. Cutter elements in certain locations of the cone cutter have more than one cutting mode. In addition to a scraping or gouging motion, some cutter elements include a twisting motion as they enter into and then separate from the formation. As such, the cutter elements 100 may be oriented to optimize cutting that takes place as the cutter element both scrapes and twists against the formation. Furthermore, as mentioned above, the type of formation material dramatically impacts a given bit's ROP. In relatively brittle formations, a given impact by a particular cutter element may remove more rock material than it would in a less brittle or a plastic formation.

The impact of a cutter element with the borehole bottom will typically remove a first volume of formation material and, in addition, will tend to cause cracks to form in the formation immediately below the material that has been removed. These cracks, in turn, allow for the easier removal of the now-fractured material by the impact from other cutter elements on the bit that subsequently impact the formation. Without being limited by this or any other particular theory, it is believed that differing the orientation of two or more inserts 100 within cone 700 as described above, will enhance formation removal and ROP by "randomizing" of the bottomhole cutting pattern, propagating additional and/or more random cracks into the uncut formation, and varying the cutting modes of different inserts as compared to uniformly positioned inserts 100 and uniformly oriented conventional bottomhole cutter elements.

The materials used in forming the various portions of embodiments of the inserts described herein (e.g., inserts 100, 200, 300) may be particularly tailored to best perform and best withstand the type of cutting duty experienced by that portion of the cutter element. For example, it is known that as a rolling cone cutter rotates within the borehole, different portions of a given insert will lead as the insert engages the formation and thereby be subjected to greater impact loading than a lagging or following portion of the same insert. With many conventional inserts, the entire cutter element was made of a single material, a material that of necessity was chosen as a compromise between the desired wear resistance or hardness and the necessary toughness. Likewise, certain conventional gage cutter elements include a portion that performs mainly side wall cutting, where a hard, wear resistant material is desirable, and another portion that performs more bottom hole cutting, where the requirement for toughness predominates over wear resistance. With the inserts described herein, the materials used in the different regions of the cutting portion can be varied and optimized to best meet the cutting demands of that particular portion.

In the embodiment illustrated in FIGS. 16 and 17 for example, because depression 130-1 and transitions surface 120-1 of insert 100-5 and rib 115-1 of insert 100-4 are intended to experience more force per unit area upon the insert's initial contact with the formation, and to be primarily responsible for formation penetration, it is desirable, in certain applications, to form depression 130-1 and transition surface 120-1 of insert 100-5 and rib 115-1 of insert 100-4 be made from a tougher, more fracture-resistant material than rib 115-3, depressions 130-2, 130-3 of insert 100-5 and ribs 115-2, 115-3 of insert 100-4. In general, the portion of insert 100 that first engages the uncut formation is preferably made of a harder, more wear-resistant material than the trailing portions of insert 100, which, by contrast, undergo more shearing and scraping actions.

Embodiments of the inserts described herein (e.g., inserts 100, 200, etc.) may be made in any conventional manner such as the process generally known as hot isostatic pressing (HIP). HIP techniques are well known manufacturing methods that employ high pressure and high temperature to consolidate metal, ceramic, or composite powder to fabricate components in desired shapes. In addition to HIP processes, the inserts and clusters described herein can be made using other conventional manufacturing processes, such as hot pressing, rapid omnidirectional compaction, vacuum sintering, or sinter-HIP.

Embodiments of the insert constructed in accordance with the descriptions herein (e.g., inserts 100, 200, etc.) may also include coatings comprising differing grades of super abrasives. Super abrasives are significantly harder than cemented tungsten carbide. As used herein, the term "super abrasive" means a material having a hardness of at least 2,700 Knoop (kg/mm$^2$). PCD grades have a hardness range of about 5,000-8,000 Knoop (kg/mm$^2$) while PCBN grades have hardnesses which fall within the range of about 2,700-3,500 Knoop (kg/mm$^2$). By way of comparison, conventional cemented tungsten carbide grades typically have a hardness of less than 1,500 Knoop (kg/mm$^2$). Such super abrasives may be applied to the cutting surfaces of all or some portions of the inserts. In many instances, improvements in wear resistance, bit life and durability may be achieved where only certain cutting portions of the inserts include the super abrasive coating.

As one specific example of employing superabrasives to insert 100, reference is again made to FIG. 16. As shown therein, depression 130-1 and transition surface 120-1 of insert 100-5, as well as rib 115-1 of insert 100-4 may be made of a relatively tough tungsten carbide, and be free of a superabrasive coating given that it must withstand more impact loading than the other portions of inserts 100-4, 100-5. (e.g., depression 130-2 of insert 100-5, rib 115-2 of insert 100-4, etc.). It is known that diamond coatings are susceptible to chipping and spalling of the diamond coating when subjected to repeated impact forces. However, ribs 115-1, 115-2 of insert 100-5 and depressions 130-1, 130-2 of insert 100-4 may be made of a first grade of tungsten carbide and coated with a diamond or other superabrasive coating to provide the desired wear resistance since these portions of inserts 100-5, 100-4 undergo more scraping and receives less impact loading.

Thus, according to these examples, employing multiple materials and/or selective use of superabrasives, the bit designer, and ultimately the driller, is provided with the opportunity to increase ROP, and bit durability.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. A cutter element for a drill bit, comprising:

a base portion;

a cutter element axis;

a cutting portion extending from the base portion and having a cutting surface with an apex;

wherein the cutting surface comprises:

at least three ribs angularly spaced apart about the cutter element axis, each rib extending from a first end at the apex to a second end proximal the base portion;

at least three continuously contoured concave depressions angularly spaced apart about the cutter element axis, each depression being circumferentially positioned between two of the ribs and axially positioned between the apex and the base portion; and wherein each rib has a continuously contoured convex outer surface extending the entire length of the rib from the first end of the rib to the second end of the rib; and wherein the cutting surface defines an outer periphery in profile view that is continuously arcuate moving lengthwise along the convex outer surface of each rib from the first end of the rib to the second end of the rib.

2. The cutter element of claim 1 wherein the base portion has a cylindrical outer surface and each rib extends to the base portion.

3. The cutter element of claim 1 further comprising a radiused transition surface extending between each depression and each adjacent rib.

4. The cutter element of claim 1 wherein each rib has non-linear lateral sides in top axial view.

5. The cutter element of claim 4 wherein each rib at least partially surrounds one of the depressions.

6. The cutter element of claim 1 wherein the at least three ribs are uniformly angularly spaced about the cutter element axis.

7. The cutter element of claim 1 wherein each depression has a shape selected from the group consisting of ovoid, oval, and circular.

8. The cutter element of claim 1 wherein the at least three ribs intersect proximal the apex to form a tip.

9. The cutter element of claim 8 wherein each rib has a first rib section, a second rib section, and a third rib section;

wherein the first rib section of each rib forms at least a portion of the tip, the second rib section is disposed between the first rib section and the third rib section, and the third rib section extends to the base portion;

wherein the first rib section of a first of the at least three ribs intersects the first rib section of a second of the at least three ribs; and wherein the third rib section of the first of the at least three ribs intersects the third rib section of the second of the at least three ribs.

10. The cutter element of claim 9 wherein the first rib section of the first of the at least three ribs intersects the first rib section of a third of the at least three ribs, and the third rib section of the first of the at least three ribs intersects the third rib section of the third of the at least three ribs.

11. The drill bit of claim 1 wherein each rib is angularly spaced about 120° from one of the other ribs.

12. The drill bit of claim 1 wherein each concave depression has a length measured along a major axis and a width measured along a minor axis, wherein a projection of the major axis of each depression intersects the cutter element axis.

13. A cutter element for use in a rolling cone drill bit, comprising:

a base portion having a central axis;

a cutting portion extending from the base portion and having a cutting surface with an apex, wherein the cutting surface includes:

a plurality of ribs, each rib radiating from a first end at the apex to a second end proximal the base portion, wherein at least one of the plurality of ribs has a continuously contoured outer surface extending the entire length of the rib from the first end of the rib to the second end of the rib and a pair of arcuate lateral sides in top axial view;

wherein the cutting surface defines an outer periphery in profile view that is continuously arcuate moving lengthwise along the convex outer surface of each rib from the first end of the rib to the second end of the rib;

a plurality of continuously contoured concave depressions, each depression being circumferentially disposed between two of the plurality of ribs, wherein each depression has a shape selected from the group consisting of ovoid and oval; and wherein each concave depression has a length measured along a major axis and a width measured along a minor axis, wherein a projection of the major axis of each depression intersects the central axis.

14. The cutter element of claim 13 wherein the outer surface of the at least one of the plurality of ribs is convex in profile view.

15. The cutter element of claim 13 wherein the cutting surface further comprises a plurality of radiused transition surfaces, wherein one of the plurality of transition surfaces extends between each rib and each depression.

16. The cutter element of claim 13 wherein the plurality of ribs intersect proximal the apex to form a tip.

17. The drill bit of claim 13 wherein each rib is angularly spaced about 120° from one of the other ribs.

18. A rolling cone drill bit for drilling a borehole in earthen formations, the bit comprising:

a bit body having a bit axis;

at least one rolling cone cutter mounted on the bit body for rotation about a cone axis and having a first surface for cutting the borehole bottom and second surface for cutting the borehole sidewall;

a plurality of cutter elements secured to the cone cutter and extending from the first surface;

wherein at least one of the cutter elements comprises:

a base portion having a central axis;

a cutting portion extending from the base portion, wherein the cutting portion includes:

a cutting surface with an apex defining an extension height;

at least three ribs angularly spaced apart about the central axis, each rib extending from a first end at the apex to a second end proximal the base portion;

wherein each rib has a continuously contoured convex outer surface extending the entire length of the rib from the first end of the rib to the second end of the rib;

wherein the cutting surface defines an outer periphery in profile view that is continuously arcuate moving lengthwise along the convex outer surface of each rib from the first end of the rib to the second end of the rib; and at least three continuously contoured concave depressions angularly spaced apart about the central axis, each depression being circumferentially positioned between two of the ribs and axially positioned between the apex and the base portion.

19. The drill bit of claim 18 wherein the at least one rib has non-linear lateral sides in top axial view.

20. The drill bit of claim 18 wherein the base portion has a cylindrical outer surface and each rib extends to the cylindrical outer surface of the base portion.

21. The drill bit of claim 18 wherein the ribs intersect proximal the apex to form a tip.

22. The drill bit of claim 18 wherein the depressions are uniformly angularly spaced about the cutter element axis.

23. The drill bit of claim 18 wherein the plurality of cutter elements are positioned in a circumferential row, wherein each cutter element in the circumferential row comprises:

a base portion;

a cutting portion extending from the base portion, wherein the cutting portion includes a cutting surface with an apex and a plurality of ribs;

wherein each rib extends from the apex toward the base portion and includes a continuously contoured convex outer surface in profile view.

24. The drill bit of claim 23 wherein each cutter element in the first circumferential row further comprises a plurality of continuously contoured concave depressions, wherein each depression is positioned between two of the plurality of ribs.

25. The drill bit of claim 24 wherein the at least one rolling cone has a direction of rotation and each of the plurality of inserts has a leading portion and a trailing portion, wherein a first of the plurality of cutter elements is positioned with the convex outer surface of one of its ribs perpendicular to the direction of rotation and on the leading portion of the first of the plurality of cutter elements and a second of the plurality of cutter elements is positioned with one of its concave depressions perpendicular to the direction of rotation and on the leading portion of the second of the plurality of cutter elements.

26. A rolling cone drill bit for drilling through earthen formations to form a borehole with a hole bottom and a sidewall, the drill bit comprising:

at least one rolling cone cutter rotatably mounted on a bit body, the rolling cone cutter including a first surface generally facing the borehole bottom and a second surface generally facing the sidewall of the borehole;

at least one cutter element mounted in the rolling cone cutter and secured in a position to cut against the borehole bottom;

wherein the at least one cutter element comprises:

a base portion having a central axis;

a cutting portion having a cutting surface extending from the base portion to a continuously contoured tip;

wherein the cutting surface includes a plurality of ribs, each rib radiating from a first end at the tip to a second end proximal the base portion;

wherein each rib has a continuously contoured convex outer surface extending the entire length of the rib from the first end of the rib to the second end of the rib, and a pair of arcuate lateral sides in top axial view;

wherein the cutting surface defines an outer in profile view that is continuously arcuate moving lengthwise along the convex outer surface of each rib from the first end of the rib to the second end of the rib;

a plurality of continuously contoured concave depressions, each depression being circumferentially disposed between two of the plurality of ribs, wherein each depression has a shape selected from the group consisting of ovoid and oval; and wherein each concave depression has a length measured along a major axis and a width measured along a minor axis, wherein a projection of the major axis of each depression intersects the central axis.

27. The drill bit of claim 26 wherein the continuously contoured outer surface of each rib is convex in profile view.

* * * * *